US007458839B2

(12) United States Patent
Ngo et al.

(10) Patent No.: US 7,458,839 B2
(45) Date of Patent: Dec. 2, 2008

(54) ELECTRICAL CONNECTORS HAVING POWER CONTACTS WITH ALIGNMENT AND/OR RESTRAINING FEATURES

(75) Inventors: Hung Viet Ngo, Harrisburg, PA (US); Wilfred James Swain, Mechanicsburg, PA (US); Christopher G. Daily, Harrisburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/358,168

(22) Filed: Feb. 21, 2006

(65) Prior Publication Data

US 2007/0197063 A1 Aug. 23, 2007

(51) Int. Cl.
*H01R 13/28* (2006.01)

(52) U.S. Cl. ..... 439/291

(58) Field of Classification Search ..... 439/290, 439/284, 285, 287, 291
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 1,477,527 | A | 12/1923 | Raettig | |
| 2,248,675 | A | 7/1941 | Huppert | 113/119 |
| 2,430,011 | A | 11/1947 | Gillentine | 173/361 |
| 2,759,163 | A | 8/1956 | Ustin et al. | 339/217 |
| 2,762,022 | A | 9/1956 | Benander et al. | 339/47 |
| 2,844,644 | A | 7/1958 | Soule, Jr. | 174/35 |
| 3,011,143 | A | 11/1961 | Dean | 339/49 |
| 3,178,669 | A | 4/1965 | Roberts | 339/49 |
| 3,208,030 | A | 9/1965 | Evans et al. | |
| 3,286,220 | A | 11/1966 | Marley et al. | 439/680 |
| 3,411,127 | A | 11/1968 | Adams | 339/47 |
| 3,420,087 | A | 1/1969 | Hatfield | |
| 3,514,740 | A * | 5/1970 | Filson | 439/290 |
| 3,538,486 | A | 11/1970 | Shlesinger, Jr. | 439/268 |
| 3,634,811 | A | 1/1972 | Teagno et al. | 339/47 |
| 3,669,054 | A | 6/1972 | Desso et al. | 113/119 |
| 3,692,994 | A | 9/1972 | Hirschmann et al. | 240/11.4 |
| 3,748,633 | A | 7/1973 | Lundergan | 339/217 |
| 3,845,451 | A | 10/1974 | Neidecker | 339/49 |
| 3,871,015 | A | 3/1975 | Lin et al. | 357/67 |
| 3,942,856 | A * | 3/1976 | Mindheim et al. | 439/346 |
| 3,972,580 | A | 8/1976 | Pemberton et al. | 339/47 |
| 4,070,088 | A | 1/1978 | Vaden | 339/252 |

(Continued)

FOREIGN PATENT DOCUMENTS

| | | |
|---|---|---|
| DE | 1 665 181 | 4/1974 |

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner*—Chandrika Prasad
(74) *Attorney, Agent, or Firm*—Woodcock Washburn LLP

(57) ABSTRACT

Preferred embodiments of power contacts have alignment features that can maintain conductors of the power contacts in a state of alignment during and after insertion of the power contacts into a housing.

31 Claims, 14 Drawing Sheets

U.S. PATENT DOCUMENTS

| | | | | | |
|---|---|---|---|---|---|
| 4,076,362 | A | | 2/1978 | Ichimura | 339/75 |
| 4,136,919 | A | * | 1/1979 | Howard et al. | 439/346 |
| 4,159,861 | A | | 7/1979 | Anhalt | 339/75 |
| 4,217,024 | A | | 8/1980 | Aldridge et al. | 339/275 |
| 4,260,212 | A | | 4/1981 | Ritchie et al. | 339/97 |
| 4,288,139 | A | | 9/1981 | Cobaugh et al. | 339/74 |
| 4,371,912 | A | | 2/1983 | Guzik | 361/417 |
| 4,383,724 | A | | 5/1983 | Verhoeven | 439/510 |
| 4,402,563 | A | | 9/1983 | Sinclair | 339/75 |
| 4,403,821 | A | | 9/1983 | Zimmerman, Jr. et al. | 339/97 |
| 4,505,529 | A | | 3/1985 | Barkus | 439/82 |
| 4,536,955 | A | | 8/1985 | Gudgeon | 29/840 |
| 4,545,610 | A | | 10/1985 | Lakritz et al. | 29/589 |
| 4,552,425 | A | * | 11/1985 | Billman | 439/295 |
| 4,560,222 | A | | 12/1985 | Dambach | 339/75 |
| 4,564,259 | A | | 1/1986 | Vandame | 339/258 |
| 4,685,886 | A | | 8/1987 | Denlinger et al. | 439/55 |
| 4,717,360 | A | | 1/1988 | Czaja | 439/710 |
| 4,767,344 | A | | 8/1988 | Noschese | 439/83 |
| 4,776,803 | A | | 10/1988 | Pretchel et al. | 439/59 |
| 4,815,987 | A | | 3/1989 | Kawano et al. | 439/263 |
| 4,820,182 | A | | 4/1989 | Harwath et al. | 439/290 |
| 4,867,713 | A | | 9/1989 | Ozu et al. | 439/833 |
| 4,878,611 | A | | 11/1989 | LoVasco et al. | 228/180.2 |
| 4,881,905 | A | | 11/1989 | Demler, Jr. et al. | 439/79 |
| 4,900,271 | A | | 2/1990 | Colleran et al. | 439/595 |
| 4,907,990 | A | | 3/1990 | Bertho et al. | 439/851 |
| 4,963,102 | A | | 10/1990 | Gettig et al. | 439/291 |
| 4,973,257 | A | | 11/1990 | Lhotak | 439/81 |
| 4,973,271 | A | | 11/1990 | Ishizuka et al. | 439/839 |
| 5,024,610 | A | | 6/1991 | French et al. | 439/857 |
| 5,035,639 | A | | 7/1991 | Kilpatrick et al. | 439/290 |
| 5,052,953 | A | | 10/1991 | Weber | 439/857 |
| 5,066,236 | A | | 11/1991 | Broeksteeg | 439/79 |
| 5,077,893 | A | | 1/1992 | Mosquera et al. | 29/882 |
| 5,082,459 | A | | 1/1992 | Billman et al. | 439/637 |
| 5,094,634 | A | | 3/1992 | Dixon et al. | 431/751 |
| 5,104,332 | A | | 4/1992 | McCoy | 439/290 |
| 5,174,770 | A | | 12/1992 | Sasaki et al. | 439/108 |
| 5,214,308 | A | | 5/1993 | Nishiguchi | 257/692 |
| 5,238,414 | A | | 8/1993 | Yaegashi et al. | 439/108 |
| 5,254,012 | A | | 10/1993 | Wang | 439/263 |
| 5,274,918 | A | | 1/1994 | Reed | 29/882 |
| 5,276,964 | A | | 1/1994 | Anderson, Jr. et al. | |
| 5,302,135 | A | | 4/1994 | Lee | 439/263 |
| 5,381,314 | A | | 1/1995 | Rudy, Jr. et al. | 361/712 |
| 5,400,949 | A | | 3/1995 | Hirvonen et al. | 228/180.22 |
| 5,427,543 | A | * | 6/1995 | Dynia | 439/346 |
| 5,431,578 | A | | 7/1995 | Wayne | 439/259 |
| 5,457,342 | A | | 10/1995 | Herbst, II | 257/712 |
| 5,475,922 | A | | 12/1995 | Tamura et al. | 29/881 |
| 5,490,040 | A | | 2/1996 | Gavdenzi et al. | 361/773 |
| 5,533,915 | A | | 7/1996 | Deans | 439/678 |
| 5,558,542 | A | | 9/1996 | O'Sullivan et al. | 439/682 |
| 5,577,928 | A | | 11/1996 | Duclos | 439/290 |
| 5,582,519 | A | | 12/1996 | Buchter | |
| 5,588,859 | A | | 12/1996 | Maurice | 439/290 |
| 5,590,463 | A | | 1/1997 | Feldman et al. | 29/844 |
| 5,609,502 | A | | 3/1997 | Thumma | 439/747 |
| 5,618,187 | A | | 4/1997 | Goto | 439/79 |
| 5,637,008 | A | | 6/1997 | Kozel | 439/342 |
| 5,643,009 | A | | 7/1997 | Dinkel et al. | |
| 5,664,973 | A | | 9/1997 | Emmert et al. | 439/862 |
| 5,691,041 | A | | 11/1997 | Frankeny et al. | 428/209 |
| 5,702,255 | A | | 12/1997 | Murphy et al. | 439/71 |
| 5,730,609 | A | | 3/1998 | Harwath | 439/108 |
| 5,741,144 | A | | 4/1998 | Elco et al. | 439/101 |
| 5,741,161 | A | | 4/1998 | Cahaly et al. | 439/709 |
| 5,742,484 | A | | 4/1998 | Gillette et al. | 361/789 |
| 5,743,009 | A | | 4/1998 | Matsui et al. | 29/843 |
| 5,745,349 | A | | 4/1998 | Lemke | 361/818 |
| 5,746,608 | A | | 5/1998 | Taylor | 439/70 |
| 5,755,595 | A | | 5/1998 | Davis et al. | 439/607 |
| 5,772,451 | A | | 6/1998 | Dozier, II et al. | 439/70 |
| 5,787,971 | A | | 8/1998 | Dodson | 165/121 |
| 5,795,191 | A | | 8/1998 | Preputnick et al. | 439/608 |
| 5,810,607 | A | | 9/1998 | Shih et al. | 439/66 |
| 5,817,973 | A | | 10/1998 | Elco et al. | 174/32 |
| 5,827,094 | A | * | 10/1998 | Aizawa et al. | 439/857 |
| 5,831,314 | A | | 11/1998 | Wen | 257/391 |
| 5,857,857 | A | | 1/1999 | Fukuda | 439/188 |
| 5,874,776 | A | | 2/1999 | Kresge et al. | 257/747 |
| 5,876,219 | A | | 3/1999 | Taylor et al. | 439/74 |
| 5,876,248 | A | | 3/1999 | Brunker et al. | |
| 5,883,782 | A | | 3/1999 | Thurston et al. | 364/704 |
| 5,888,884 | A | | 3/1999 | Wojnarowski | 438/462 |
| 5,908,333 | A | | 6/1999 | Perino et al. | 439/631 |
| 5,919,050 | A | | 7/1999 | Kehley et al. | 439/71 |
| 5,930,114 | A | | 7/1999 | Kuzmin et al. | 361/704 |
| 5,955,888 | A | | 9/1999 | Frederickson et al. | 324/761 |
| 5,961,355 | A | | 10/1999 | Morlion et al. | 439/686 |
| 5,971,817 | A | | 10/1999 | Longueville | 439/857 |
| 5,975,921 | A | | 11/1999 | Shuey | 439/83 |
| 5,980,270 | A | | 11/1999 | Fjelstad et al. | 439/71 |
| 5,980,321 | A | | 11/1999 | Cohen et al. | 439/608 |
| 5,984,726 | A | | 11/1999 | Wu | 439/607 |
| 5,993,259 | A | | 11/1999 | Stokoe et al. | 439/608 |
| 6,012,948 | A | | 1/2000 | Wu | 439/567 |
| 6,050,862 | A | | 4/2000 | Ishii | 439/843 |
| 6,059,170 | A | | 5/2000 | Jimarez et al. | 228/119 |
| 6,068,520 | A | | 5/2000 | Winings et al. | 439/676 |
| 6,071,152 | A | | 6/2000 | Achammer et al. | 439/733.1 |
| 6,077,130 | A | | 6/2000 | Hughes et al. | 439/862 |
| 6,089,878 | A | | 7/2000 | Meng | 439/79 |
| 6,095,827 | A | | 8/2000 | Dutkowsky et al. | 439/83 |
| 6,123,554 | A | | 9/2000 | Ortega et al. | 439/79 |
| 6,125,535 | A | | 10/2000 | Chiou et al. | 29/883 |
| 6,139,336 | A | | 10/2000 | Olson | 439/83 |
| 6,146,157 | A | | 11/2000 | Lenoir et al. | 439/101 |
| 6,146,202 | A | | 11/2000 | Ramey et al. | 439/608 |
| 6,146,203 | A | | 11/2000 | Elco et al. | 439/608 |
| 6,152,756 | A | | 11/2000 | Huang et al. | 439/342 |
| 6,174,198 | B1 | | 1/2001 | Wu et al. | 439/541.5 |
| 6,180,891 | B1 | | 1/2001 | Murdeshwar | 174/260 |
| 6,183,287 | B1 | | 2/2001 | Po | |
| 6,183,301 | B1 | | 2/2001 | Paagman | 439/608 |
| 6,190,213 | B1 | | 2/2001 | Reichart et al. | 439/736 |
| 6,193,537 | B1 | | 2/2001 | Harper, Jr. et al. | 439/291 |
| 6,196,871 | B1 | | 3/2001 | Szu | 439/571 |
| 6,202,916 | B1 | | 3/2001 | Updike et al. | 228/180 |
| 6,210,197 | B1 | | 4/2001 | Yu | 439/342 |
| 6,210,240 | B1 | | 4/2001 | Comerci et al. | 439/853 |
| 6,212,755 | B1 | | 4/2001 | Shimada et al. | 29/527.1 |
| 6,215,180 | B1 | | 4/2001 | Chen et al. | 257/720 |
| 6,219,913 | B1 | | 4/2001 | Uchiyama | 29/883 |
| 6,220,884 | B1 | | 4/2001 | Lin | 439/342 |
| 6,220,895 | B1 | | 4/2001 | Lin | 439/607 |
| 6,220,896 | B1 | | 4/2001 | Bertoncici et al. | 439/608 |
| 6,234,851 | B1 | | 5/2001 | Phillips | 439/825 |
| 6,257,478 | B1 | | 7/2001 | Straub | 228/6.2 |
| 6,259,039 | B1 | | 7/2001 | Chroneos, Jr. et al. | 174/263 |
| 6,269,539 | B1 | | 8/2001 | Takahashi et al. | 29/883 |
| 6,272,474 | B1 | | 8/2001 | Caletka et al. | 438/613 |
| 6,293,827 | B1 | | 9/2001 | Stokoe et al. | 439/608 |
| 6,299,492 | B1 | * | 10/2001 | Pierini et al. | 439/884 |
| 6,309,245 | B1 | | 10/2001 | Sweeney | 439/507 |
| 6,319,075 | B1 | | 11/2001 | Clark et al. | 439/825 |
| 6,328,602 | B1 | | 12/2001 | Yamasaki et al. | 439/608 |
| 6,347,952 | B1 | | 2/2002 | Hasegawa et al. | 439/608 |
| 6,350,134 | B1 | | 2/2002 | Fogg et al. | 439/79 |
| 6,359,783 | B1 | | 3/2002 | Noble | 361/704 |
| 6,360,940 | B1 | | 3/2002 | Bolde et al. | 228/264 |
| 6,362,961 | B1 | | 3/2002 | Chiou | 361/704 |
| 6,363,607 | B1 | | 4/2002 | Chen et al. | 29/883 |

| | | | | |
|---|---|---|---|---|
| 6,371,773 | B1 | 4/2002 | Crofoot et al. | 439/79 |
| 6,379,188 | B1 | 4/2002 | Cohen et al. | 439/608 |
| 6,386,924 | B2 | 5/2002 | Long | 439/701 |
| 6,409,543 | B1 | 6/2002 | Astbury, Jr. et al. | 439/608 |
| 6,428,328 | B2 | 8/2002 | Haba et al. | 439/70 |
| 6,431,914 | B1 | 8/2002 | Billman | 439/608 |
| 6,435,914 | B1 | 8/2002 | Billman | 439/608 |
| 6,461,202 | B2 | 10/2002 | Kline | 439/701 |
| 6,471,523 | B1 | 10/2002 | Shuey | 439/63 |
| 6,471,548 | B2 | 10/2002 | Bertoncini et al. | 439/608 |
| 6,506,081 | B2 | 1/2003 | Blanchfield et al. | 439/682 |
| 6,514,103 | B2 | 2/2003 | Pape et al. | 439/608 |
| 6,537,111 | B2 | 3/2003 | Brammer et al. | 439/857 |
| 6,544,046 | B1 | 4/2003 | Hahn et al. | 439/83 |
| 6,551,112 | B1 | 4/2003 | Li et al. | 439/66 |
| 6,554,647 | B1 | 4/2003 | Cohen et al. | 439/607 |
| 6,572,410 | B1 | 6/2003 | Volstorf et al. | 439/608 |
| 6,592,381 | B2 | 7/2003 | Cohen et al. | 439/80 |
| 6,652,318 | B1 | 11/2003 | Winings et al. | 439/608 |
| 6,663,426 | B2 | 12/2003 | Hasircoglu et al. | 439/608 |
| 6,665,189 | B1 | 12/2003 | Lebo | 361/730 |
| 6,669,514 | B2 | 12/2003 | Wiebking et al. | 439/701 |
| 6,672,907 | B2 | 1/2004 | Azuma | 439/682 |
| 6,692,272 | B2 | 2/2004 | Lemke et al. | 439/108 |
| 6,702,594 | B2 | 3/2004 | Lee et al. | 439/83 |
| 6,705,902 | B1 | 3/2004 | Yi et al. | 439/678 |
| 6,712,621 | B2 | 3/2004 | Li et al. | 439/65 |
| 6,716,068 | B2 | 4/2004 | Wu | 439/733.1 |
| 6,740,820 | B2 | 5/2004 | Cheng | 174/260 |
| 6,743,037 | B2 | 6/2004 | Kassa et al. | 439/342 |
| 6,746,278 | B2 | 6/2004 | Nelson et al. | 439/608 |
| 6,769,883 | B2 | 8/2004 | Brid et al. | |
| 6,769,935 | B2 | 8/2004 | Stokoe et al. | 439/608 |
| 6,776,635 | B2 | 8/2004 | Blanchfield et al. | 439/181 |
| 6,776,649 | B2 | 8/2004 | Pape et al. | 439/485 |
| 6,790,088 | B2 | 9/2004 | Ono et al. | 439/607 |
| 6,796,831 | B1 | 9/2004 | Yasufuku et al. | 439/485 |
| 6,811,440 | B1 | 11/2004 | Rothermel et al. | 439/608 |
| 6,835,103 | B2 | 12/2004 | Middlehurst et al. | 439/699.1 |
| 6,843,687 | B2 | 1/2005 | McGowan et al. | 439/608 |
| 6,848,886 | B2 | 2/2005 | Schmaling et al. | 416/134 |
| 6,848,950 | B2 | 2/2005 | Allison et al. | 439/682 |
| 6,848,953 | B2 | 2/2005 | Schell et al. | 439/825 |
| 6,869,294 | B2 | 3/2005 | Clark et al. | 439/79 |
| 6,884,117 | B2 | 4/2005 | Korsunsky et al. | 439/607 |
| 6,890,221 | B2 | 5/2005 | Wagner | 439/855 |
| 6,905,367 | B2 * | 6/2005 | Crane et al. | 439/608 |
| 6,929,504 | B2 | 8/2005 | Ling et al. | 439/485 |
| 6,947,012 | B2 | 9/2005 | Aisenbrey | 343/906 |
| 6,975,511 | B1 | 12/2005 | Lebo et al. | 361/703 |
| 6,994,569 | B2 | 2/2006 | Minich et al. | 439/79 |
| 7,001,189 | B1 | 2/2006 | McGowan et al. | 439/79 |
| 7,070,464 | B2 | 7/2006 | Clark et al. | 439/825 |
| 7,074,096 | B2 | 7/2006 | Copper et al. | 439/843 |
| 7,101,228 | B2 | 9/2006 | Hammer et al. | 439/637 |
| 7,104,812 | B1 | 9/2006 | Bogiel et al. | 439/79 |
| 7,114,963 | B2 | 10/2006 | Shuey et al. | 439/79 |
| 7,168,963 | B2 | 1/2007 | Minich et al. | 439/79 |
| 7,182,642 | B2 | 2/2007 | Ngo et al. | 439/608 |
| D542,736 | S | 5/2007 | Rico | D13/147 |
| 7,273,382 | B2 | 9/2007 | Igarashi et al. | |
| 2001/0003685 | A1 | 6/2001 | Aritani | 439/485 |
| 2002/0106930 | A1 | 8/2002 | Pape et al. | 439/485 |
| 2002/0142676 | A1 | 10/2002 | Hosaka et al. | 439/874 |
| 2002/0159235 | A1 | 10/2002 | Miller et al. | 361/704 |
| 2002/0193019 | A1 | 12/2002 | Blanchfield et al. | 439/857 |
| 2003/0013330 | A1 | 1/2003 | Takeuchi | 439/83 |
| 2003/0143894 | A1 | 7/2003 | Kline et al. | 439/608 |
| 2003/0219999 | A1 | 11/2003 | Minich et al. | 439/79 |
| 2003/0220021 | A1 | 11/2003 | Whiteman, Jr. et al. | 439/608 |
| 2003/0236035 | A1 | 12/2003 | Kuroda et al. | 439/857 |
| 2004/0183094 | A1 | 9/2004 | Caletka et al. | 257/178 |
| 2005/0112952 | A1 | 5/2005 | Wang et al. | 439/660 |
| 2006/0003620 | A1 | 1/2006 | Daily et al. | 439/295 |
| 2006/0281354 | A1 * | 12/2006 | Ngo et al. | 439/290 |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 0091449 | B1 | 9/2004 |
| GB | 1 162 705 | | 8/1969 |
| JP | 06-236788 | | 8/1994 |
| JP | 07-114958 | | 5/1995 |
| JP | 0 812 5379 | | 5/1996 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 2003217785 | | 7/2003 |
| TW | 576555 | | 8/1991 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 01/29931 | A1 | 4/2001 |
| WO | WO 01/39332 | A1 | 5/2001 |

OTHER PUBLICATIONS

Sherman, L.M., "Plastics that Conduct Heat", Plastics Technology Online, Jun. 2001, http://www.plasticstechnology.com, 4 pages.

Ogando, J., "And now-An Injection-Molded Heat Exchanger", Sure, plastics are thermal insulators, but additive packages allow them to conduct heat instead, Global Design News, Nov. 1, 2000, 4 pages.

In the United States Patent and Trademark Office, Office Action in U.S. Appl. No. 11/441,856, filed Jun. 13, 2007, 18 pages.

In the United States Patent and Trademark Office, Office Action in U.S. Appl. No. 11/441,856, filed Feb. 16, 2007, 12 pages.

In the United States Patent and Trademark Office, Office Action in U.S. Appl. No. 11/441,856, filed Aug. 10, 2006, 10 pages.

* cited by examiner

ELECTRICAL CONNECTORS HAVING POWER CONTACTS WITH ALIGNMENT AND/OR RESTRAINING FEATURES

CROSS-REFERENCE TO RELATED APPLICATIONS

This application is related to U.S. application Ser. No. 10/919,632,filed Aug. 16, 2004; and U.S. application Ser. No. 11/303,657,filed Dec. 16, 2005. The contents of each of these applications is incorporated by reference herein in its entirety. This application is further related to U.S. Pat. No. 7,258,562, issued Aug. 21, 2007; U.S. Pat. No. 7,220,141, issued May 22, 2007; U.S. application No. 11/451,828, filed Jun. 12, 2006; U.S. Pat. No. 7,402,064, issued Jul. 22, 2008; and U.S. application No. 12/139,857, filed Jun. 16, 2008.

FIELD OF THE INVENTION

The present invention is related to electrical contacts and connectors used to transmit power to and from electrical components such as printed circuit structures.

BACKGROUND OF THE INVENTION

Power contacts used in electrical connectors can include two or more conductors. The conductors can be mounted in a side by side relationship within an electrically-insulative housing of the connector, and can be held in the housing by a press fit or other suitable means. The conductors typically include contact beams for mating with a power contact of another connector, and terminals such as solder pins for mounting the connector on a substrate.

The conductors of the power contact should be maintained in a state of alignment during and after insertion into their housing, to help ensure that the connector functions properly. For example, misalignment of the conductors can prevent the contact beams of the conductors from establishing proper electrical and mechanical contact with the power contact of the mating connector. Misalignment of the conductors can also prevent the terminals of one or both of the conductors from aligning with the through holes, solder pads, or other mounting features on the substrate. Misalignment of the conductors can occur, for example, while forcing the conductors into their housing to establish a press fit between the conductors and the housing.

Consequently, an ongoing need exists for a power contact having features that maintain two or more conductors of the power contact in a state of alignment during and after installation of the conductors in their housing.

SUMMARY OF THE INVENTION

Preferred embodiments of power contacts have alignment features that can maintain conductors of the power contacts in a state of alignment during and after insertion of the power contacts into a housing.

Preferred embodiments of electrical connectors comprise a housing, and a power contact mounted on the housing. The power contact comprises a first conductor and a second conductor that mates with the first conductor. The first conductor restrains the second conductor in a first and a second substantially perpendicular direction when the first and second conductors are mated.

Preferred embodiments of power contacts comprise a first conductor comprising a major portion, and a projection formed on the major portion. The power contacts also comprise a second conductor comprising a major portion having a through hole formed therein for receiving the projection. Interference between the projection and the first conductor restrains the first conductor in relation to the second conductor.

Preferred embodiments of electrical connectors comprise a housing, and a power contact comprising a first and a second portion. The first portion includes a projection extending from a major surface thereof. The projection has an outer surface oriented in a direction substantially perpendicular to the major surface. The projection maintains the first and the second portions in a state of alignment as the first and second portions are inserted into the housing.

Preferred methods for manufacturing a power contact comprises forming a projection on a first conductor of the power contact by displacing material of the first conductor using a punch, without penetrating the material. The method also comprises forming a through hole a second conductor of the power contact by penetrating material of the second conductor using the punch.

Preferred embodiments of electrical connectors comprise a housing, and a power contact mounted on the housing. The power contact comprises a first conductor and a second conductor that mates with the first conductor. The first conductor can include a first plate member, and a first and a second contact beam adjoining the first plate member. The second conductor can include second plate member, and a third and a fourth contact beam adjoining the second plate member.

The first contact beam can oppose the third contact beam when the first and second conductors are mated. The second contact beam can oppose the fourth contact beam when the first and second conductors are mated so that second and forth contact beams form a contact blade. The first and third contact beams can be pushed apart by a contact blade of a power contact of a mating connector when the connector is mated with the mating connector. The second and fourth contact beams can be received between a pair of contact beams of the power contact of the mating connector when the connector is mated with the mating connector so that the contact beams of the power contact of the mating connector clamp the second and fourth contact beams together, whereby the first and second conductors are prevented from separating.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

FIGS. 1A-1C, 3-12B, 21, and 22 depict a preferred embodiment of an electrical connector 10, and various individual components thereof. The figures are each referenced to a common coordinate system 11 depicted therein. Direction terms such as "top," "bottom," "vertical," "horizontal," "above," "below," etc. are used with reference to the component orientations depicted in FIG. 1A. These terms are used for illustrative purposes only, and are not intended to limit the scope of the appended claims.

The connector 10 is a plug connector. The present invention is described in relation to a plug connector for exemplary purposes only; the principles of the invention can also be applied to receptacle connectors.

Figure 1A:
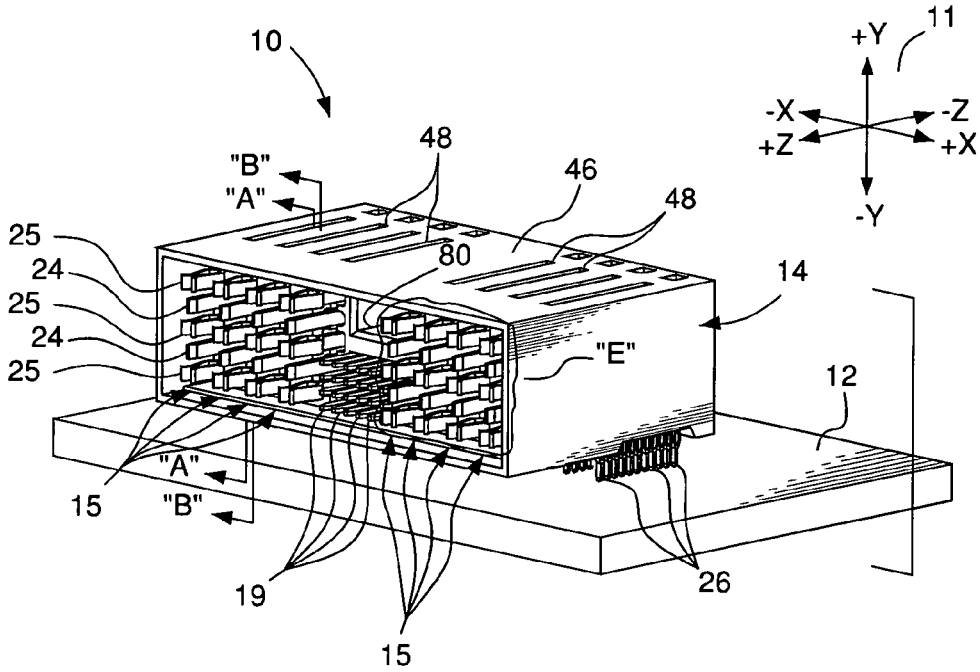
FIG. 1A is a front perspective view of a preferred embodiment of an electrical connector.
Figure 1B:
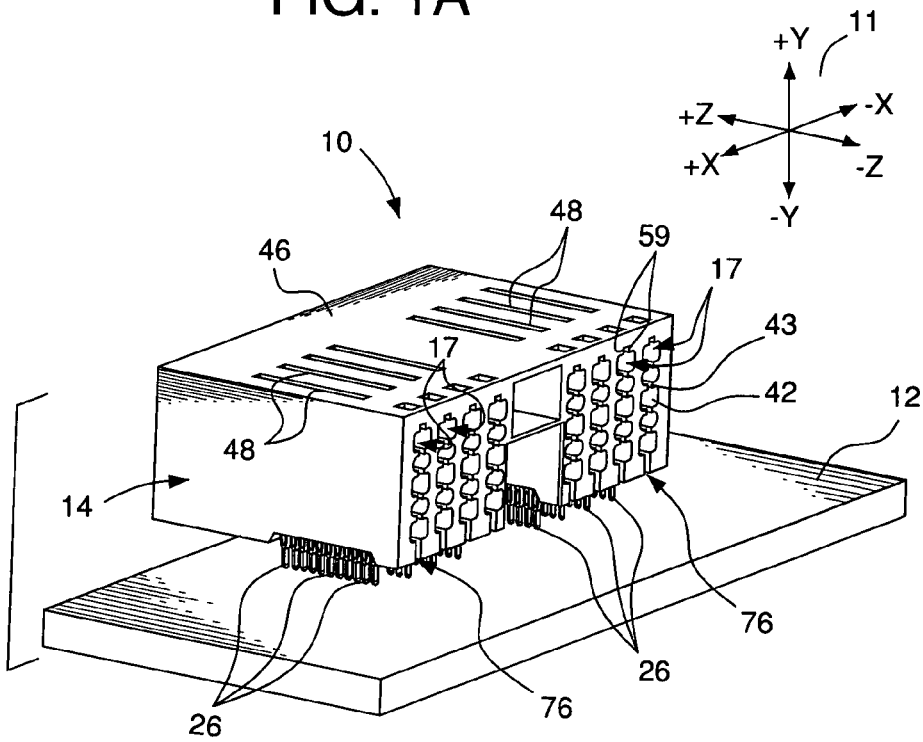
FIG. 1B is a rear perspective view of the electrical connector shown in FIG. 1A.

The connector 10 can be mounted on a substrate 12, as shown in FIGS. 1A and 1B. The connector 10 comprises a housing 14 formed from an electrically insulative material such as plastic. The connector 10 also includes eight power contacts 15 mounted in the housing 14. Alternative embodiments of the connector 10 can include less, or more than eight of the power contacts 15. The connector 10 can also include an array of signal contacts 19 positioned in apertures formed in the housing 14, proximate the center thereof.

Each power contact 15 comprises a first portion in the form of a first conductor 16, and a second portion in the form of a second conductor 18 as shown, for example, in FIGS. 3-7. The first and second conductors 16, 18, as discussed below, include features that help to maintain the first and second conductors 16, 18 in a state of alignment during and after insertion into the housing 14.

Figure 3:
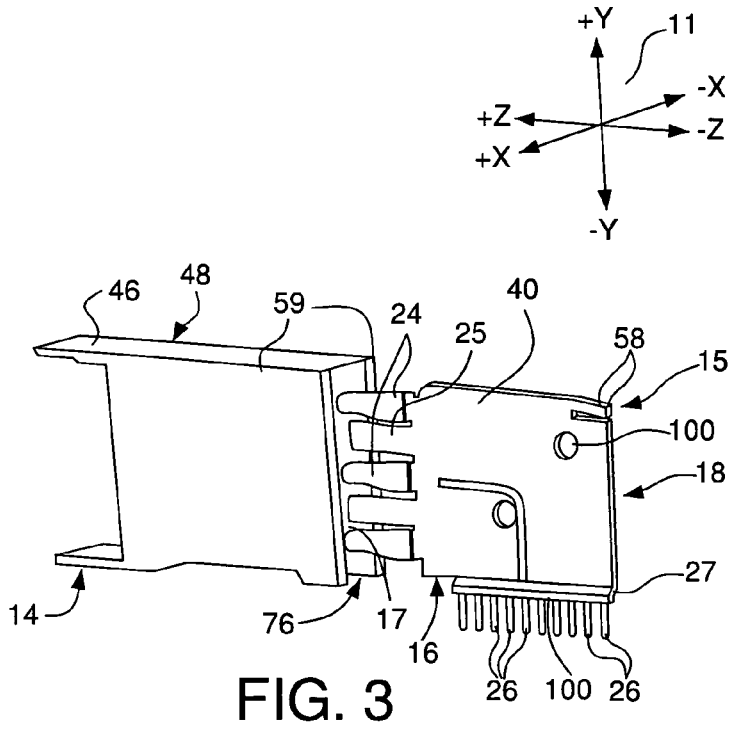
FIG. 3 is a perspective of the connector shown in FIGS. 1A and 1B, depicting a power contact having a first and a second conductor being inserted into a housing, and depicting a cross-section of the housing taken through the line "B-B" of FIG. 1A.
Figure 5:
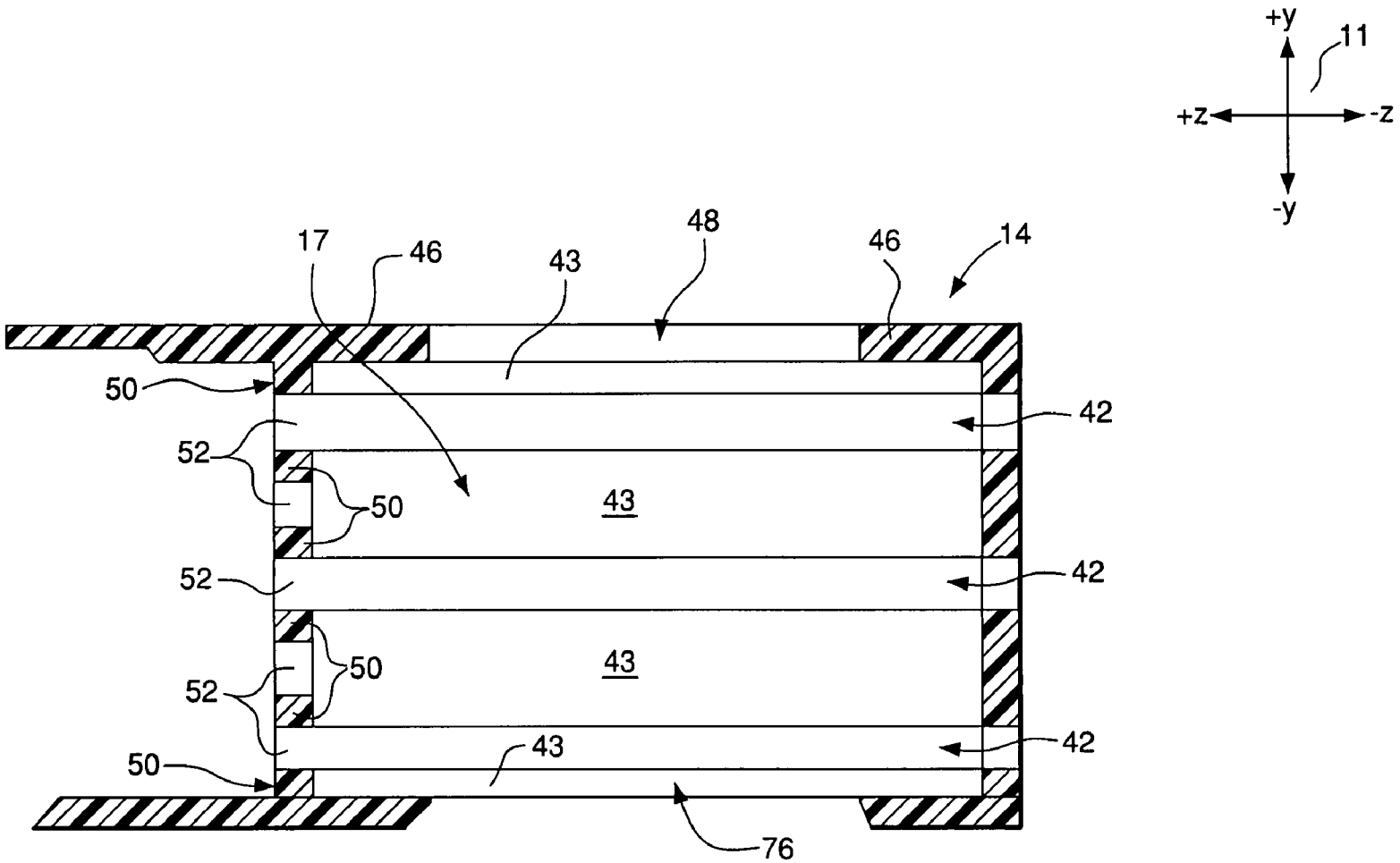
FIG. 5 is a side, cross-sectional view of the housing shown in FIG. 3, taken through the line "A-A" of FIG. 1A.
Figure 6:
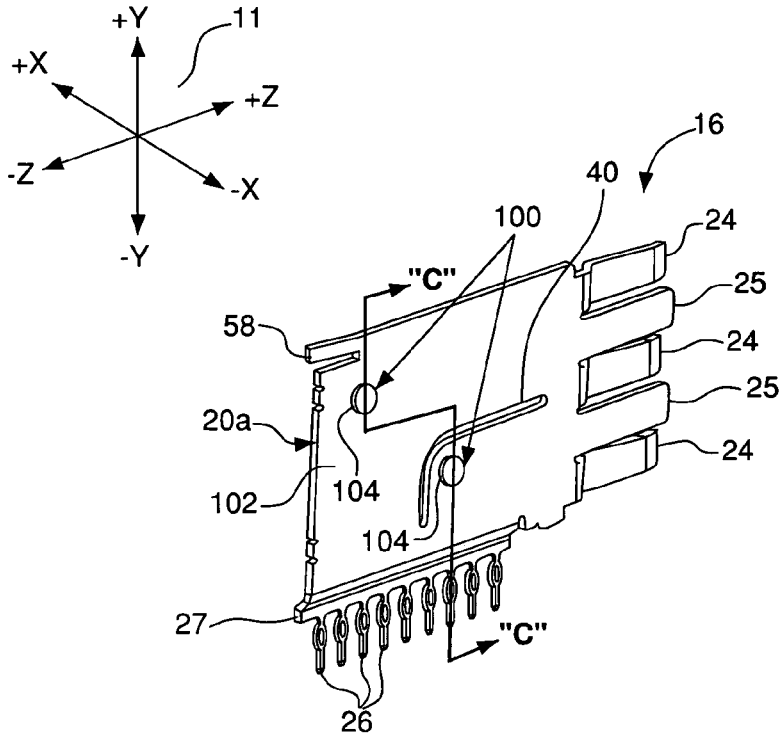
FIG. 6 is a rear perspective view of the first conductor shown in FIGS. 3 and 4.

The housing 14 includes a plurality of apertures 17 that accommodate the power contacts 15, as shown in FIG. 5. The first and second conductors 16, 18 are disposed in a side by side relationship within their associated aperture 17, as shown in FIG. 3. The first conductors 16 and the second conductors 18 are configured in right hand and left hand configurations, respectively. In other words, the first and second conductors 16, 18 of each power contact 15 are disposed in a substantially symmetrical manner about a vertically-oriented plane passing through the center of the power contact 15. The first and second conductors 16, 18 can be non-symmetric in alternative embodiments.

The first conductor 16 comprises a major portion in the form of a substantially flat plate 20*a*, and the second conductor 18 comprises a major portion in the form of a substantially flat plate 20*b* as shown, for example, in FIGS. 3-7. The plate 20*a* and the plate 20*b* abut when the first and second conductors 16, 18 are mounted in their associated aperture 17, as depicted in FIG. 3.

Each of the first and second conductors 16, 18 also comprises three contact beams 24. Each contact beam 24 of the first conductor 16 faces an associated contact beam 24 of the second conductor 18 when the first and second conductors 16, 18 are mounted in the housing 14.

Figure 2C:
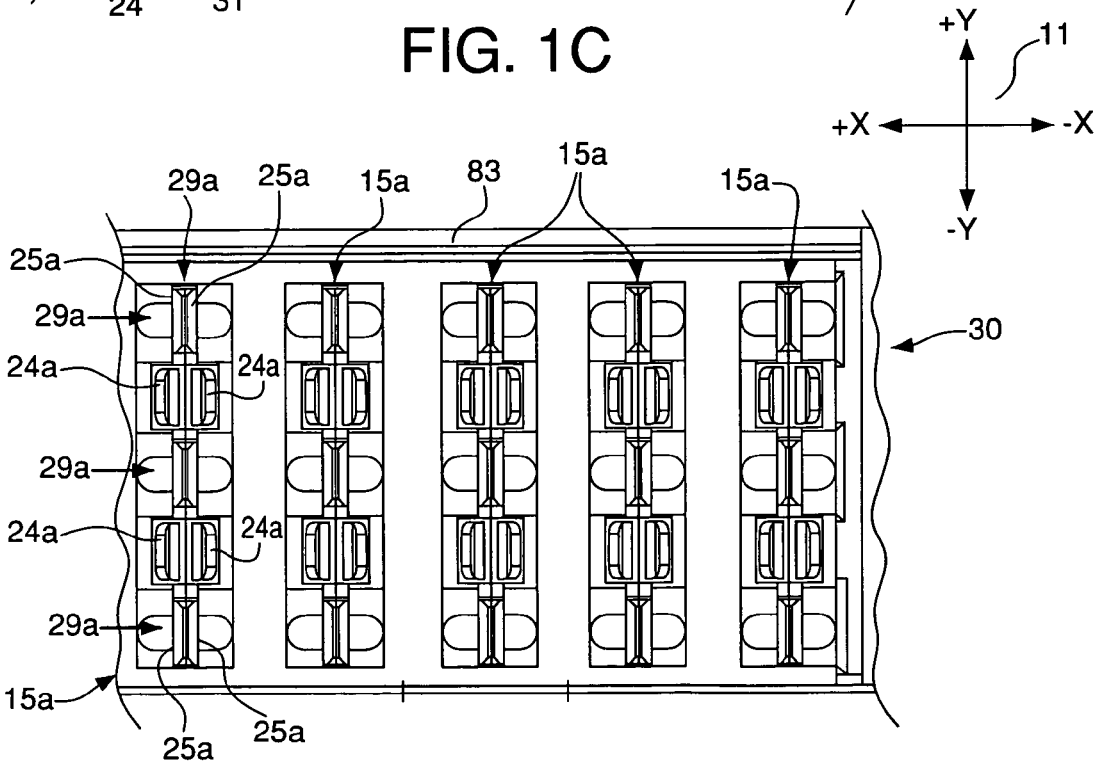
FIG. 2C is a magnified front view of the area designated "F" in FIG. 2A.
Figure 2A:
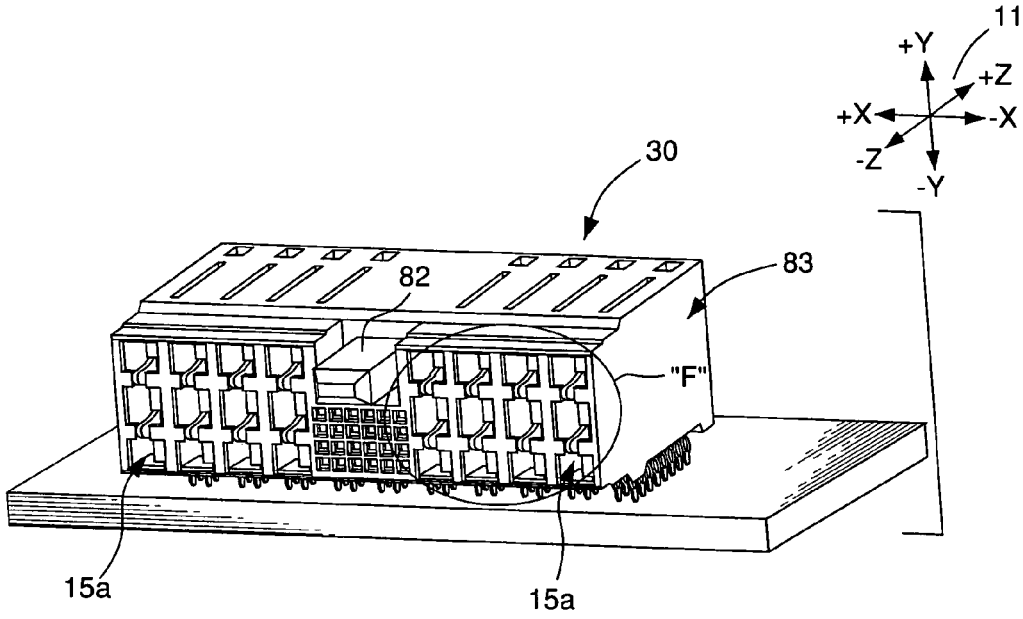
FIG. 2A is a front perspective view of a second connector capable of mating with the connector shown in FIGS. 1A and 1B.
Figure 2B:
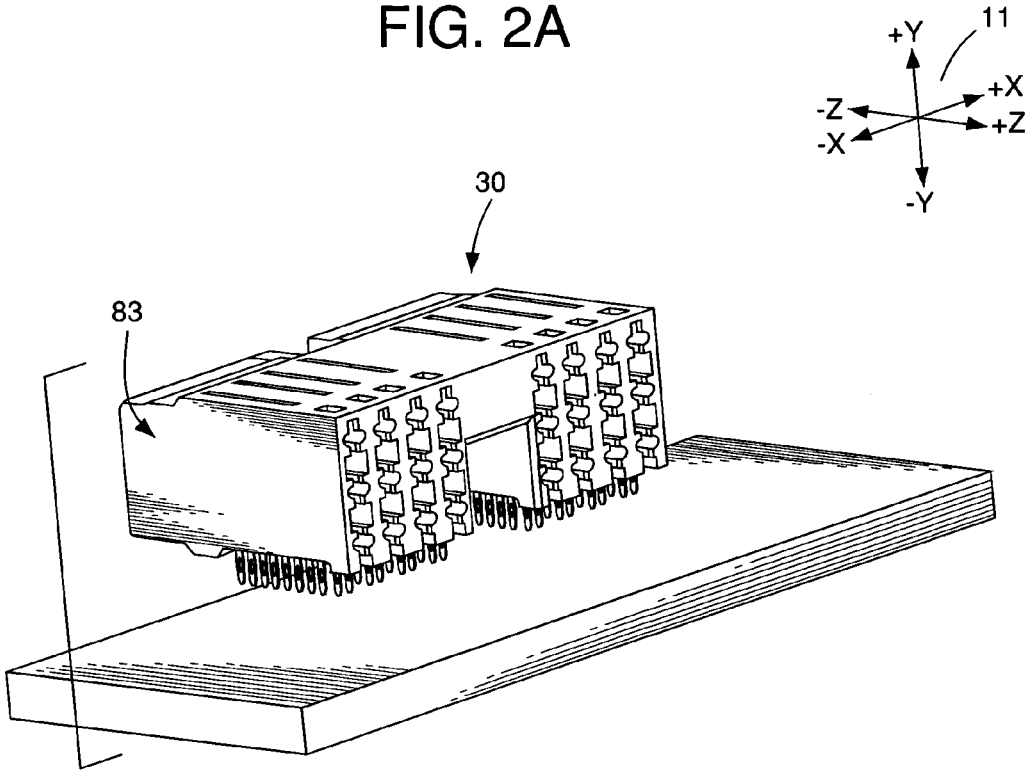
FIG. 2B is a rear perspective view of the second connector shown in FIG. 2A.

Each pair of associated contact beams 24 can receive a portion of a contact, such as a contact blade 29*a*, of another connector such a receptacle connector 30 shown in FIGS. 2A-2C. The receptacle connector 30 can include power contacts 15*a* that are substantially similar to the power contacts 15, including the below-described alignment features associated with the power contacts 15.

Figure 1C:
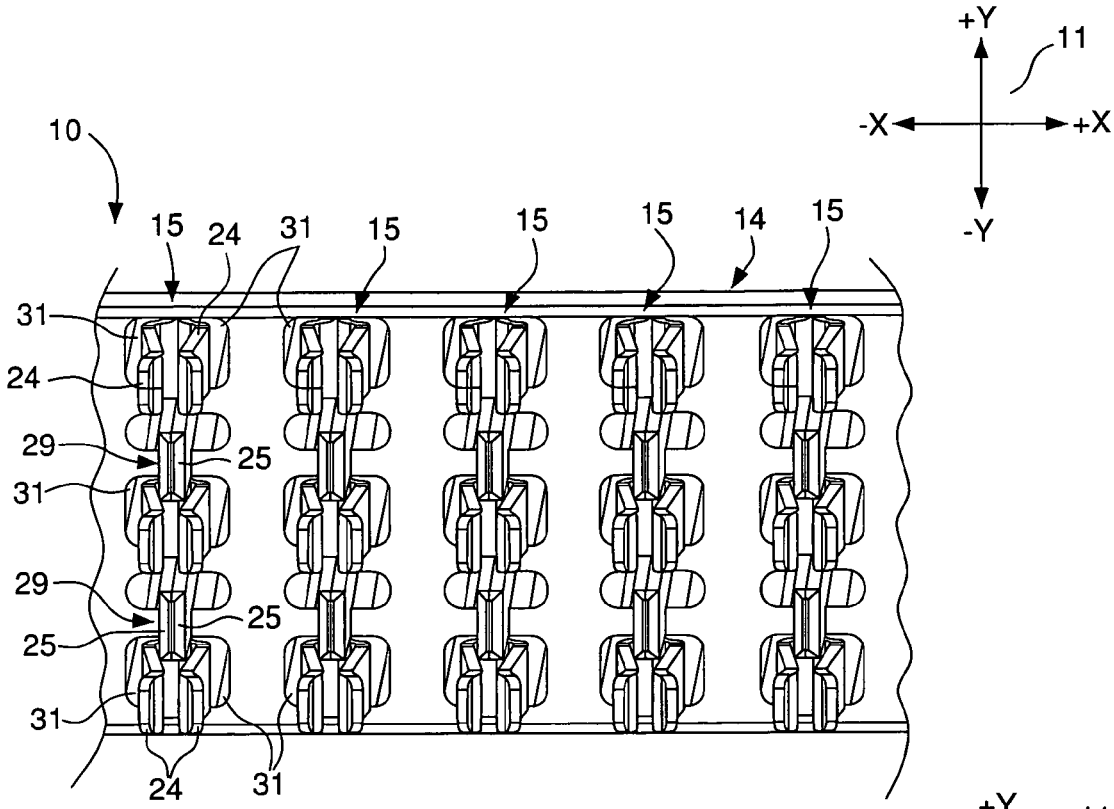
FIG. 1C is a magnified front view of the area designated "E" in FIG. 1A.
Figure 20:
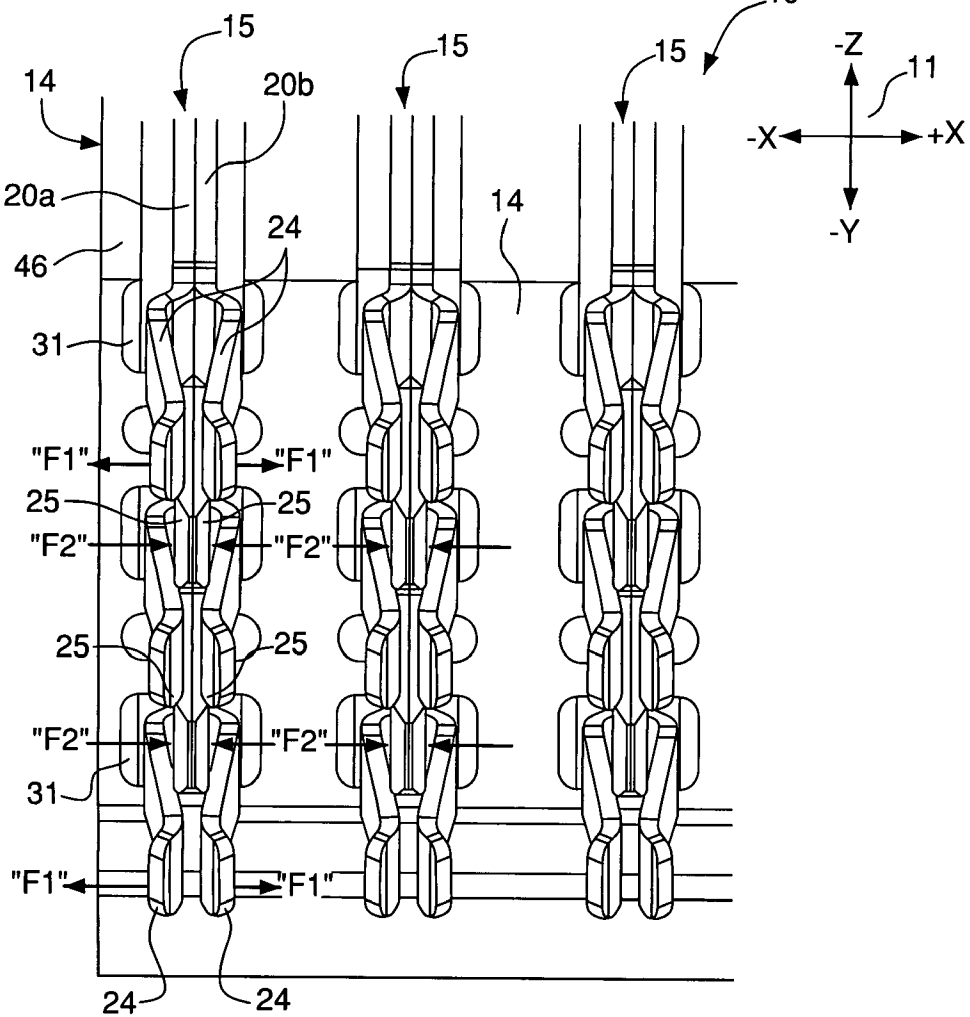
FIG. 20 is a magnified, top-front perspective view of a portion of the area designated "E" in FIG. 1.

A portion of each contact beam 24 of the power contact 15 is curved outwardly and inwardly, when viewed from above. This feature causes the opposing contact beams 24 to resiliently deflect and develop a contact force when a contact blade 29*a* of the receptacle connector 30 is inserted therebetween. The housing 14 is configured so that a clearance 31 exists between each contact beam 24 and the adjacent portion of the housing 14, as shown in FIGS. 1C and 20. The clearance 31 facilitates the noted deflection of the contact beams 24. A housing 83 of the receptacle connector 30 is likewise configured with clearances to facilitate deflection of contact beams 24*a* of the power contacts 15*a*.

Figure 4:
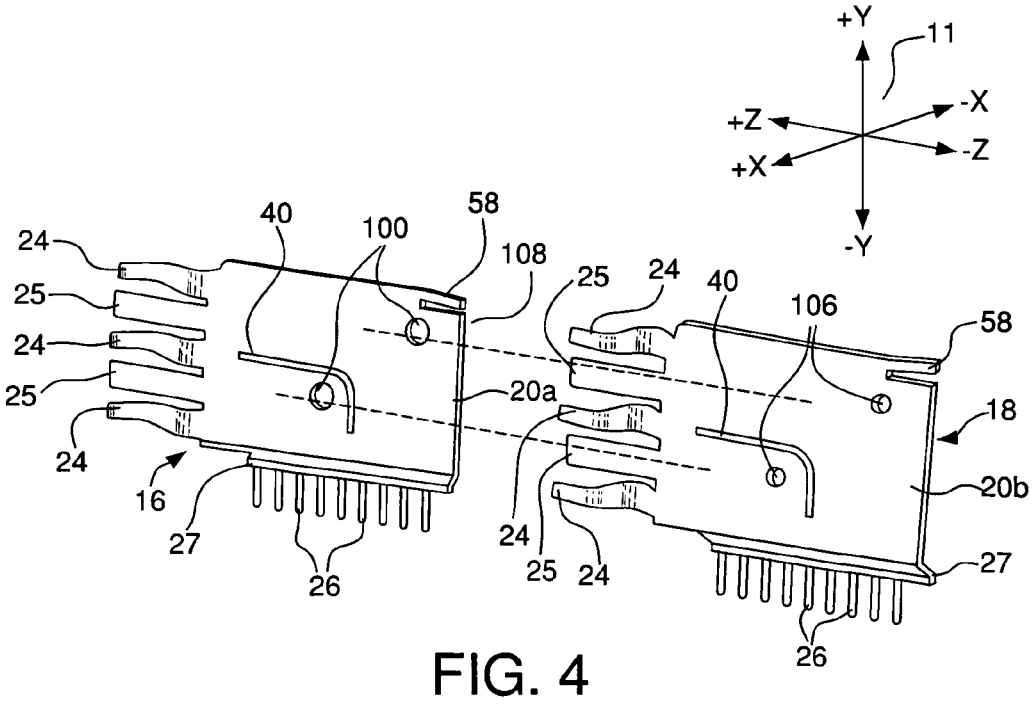
FIG. 4 is a rear perspective view of the first and a second conductors of the power contact shown in FIG. 3, depicting the first and second conductors in an unmated condition.

The contact beams 25 each have a substantially straight configuration, as shown in FIG. 4. Each contact beam 25 of the first conductor 16 abuts an associated contact beam 25 of the second conductor 18 when the first and second conductors 16, 18 are mounted in the housing 14. Each pair of associated contact beams 25 forms a contact blade 29. The contact blade 29 can be received between two opposing contact beams 24*a* of the receptacle connector 30 when the connector 10 and the receptacle connector 30 are mated.

Alternative embodiments of the first and second contacts 16, 18 can be configured with more or less than three of the contact beams 24 and two of the contact beams 25. Other alternative embodiments can be configured with contact beams shaped differently than the contact beams 24 and the contact beams 25.

Each of the first and second conductors 16, 18 also includes a substantially S-shaped portion 27, and a plurality of terminals in the form of solder tails 26. The S-shaped portion 27 adjoins the lower end of the corresponding plate 20*a*, 20*b* as shown, for example, in FIG. 8. The solder tails 26 extend from a bottom edge 27*a* of the corresponding S-shaped portion 27. The S-shaped portions 27 cause the first and second conductors 16, 18 to flare outward, as shown in FIG. 3. The S-shaped portions thus provide an offset between the solder tails 26 of the first conductor 16 and the solder tails 26 of the second conductor 18.

Each solder tail 26 can be received in a corresponding plated through hole or other mounting provision on the substrate 12. The solder tails 26 thus facilitate the transfer of power between the connector 10 and the substrate 12. Alternative embodiments of the first and second conductors 16, 18 can include press fit tails or other types of terminals in lieu of the solder tails 26.

Each of the plates 20*a*, 20*b* can include a current-guiding feature than can promote even distribution of the current flow among the contact beams 24, 25, and among the solder tails 26. The current-guiding feature can be, for example, a slot 40 formed in each of the plates 20*a*, 20*b* and shown in FIGS. 3-7. Further details of the current guiding features such as the slots 40 can be found in the above-referenced U.S. application Ser. No. 10/919,632. Alternative embodiments of the first and second conductors 16, 18 can be formed without current guiding features.

The rearward end of each aperture 17 is open, as shown in FIGS. 1B and 3. The power contacts 15 are inserted into their associated apertures 17 from behind. The portions of the housing 14 that define the sides of each aperture 17 have grooves 42 formed therein, as is best shown in FIG. 5. The grooves 42 receive the contact beams 24 as the first and second conductors 16, 18 are inserted in and moved forward through their associated apertures 17.

The grooves 42 are bordered by surface portions 43 of the housing 14, as is best shown in FIG. 5. Each surface portion 43 faces another surface portion 43 on the opposite side the associated aperture 17. The surface portions 43 are spaced apart so that the plates 20*a*, 20*b* of the associated first and second conductors 16, 18 fit between the surface portions 43 with no substantial clearance therebetween. The resulting frictional forces between the surface portions 43 and the plates 20*a*, 20*b* help to retain the first and second conductors 16, 18 in the housing 14.

A forward end of each aperture 17 is defined by a forward portion 50 of the housing 14, as shown in FIG. 5. The forward portion 50 has slots 52 formed therein. The slots 52 permit the contact beams 24, 25 of the associated power contact 15 to extend through the forward portion 50. The plates 20*a*, 20*b* of the first and second conductors 16, 18 contact the forward portion 50 when the first and second conductors 16, 18 have been fully inserted into their associated aperture 17. The forward portion 50 thus acts as a forward stop for the power contacts 15. The forward portion 50 also helps to support the power contacts 15 by way of the contact beams 24, 25 extending therethrough.

The first and second conductors 16, 18 can each include a resilient prong or tang 58, as shown in FIGS. 3-7. Each tang 58 adjoins one of the plate members 20*a*, 20*b* of the associated first or second conductors 16, 18, proximate an upper rearward corner thereof. The tangs 58 are angled outwardly, i.e., in the "x" direction, from their respective points of contact with the plate members 20*a*, 20*b*.

The housing 14 includes a plurality of lips 59, as shown in FIGS. 1B, 3, and 5. Two of the lips 59 are associated with each aperture 17. The lips 59 are located proximate an upper, rearward end of the associated aperture 17. The tangs 58 of each power contact 15 pass between two of the lips 59 during insertion of the power contact 15 into its associated aperture 17. The tangs 58 are urged inward by contact with the lips 59. The resilience of the tangs 58 causes the tangs 58 to spring outward the once the tangs 58 have cleared the lip 59. Interference between the tangs 58 and the lips 59 prevents the associated power contact 15 from backing out of its aperture 17.

The housing 14 has a top portion 46. The top portion 46 can have a plurality of slots 48 formed therein, as shown in FIGS. 1A, 1B, 3, and 5. Each slot 48 is aligned with, and adjoins an associated aperture 17. The slots 48 can facilitate convective heat transfer from the power contacts 15 positioned in the associated apertures 17, as described in the above-referenced application titled "Electrical Connector with Cooling Features." Alternative embodiments of the housing 14 can be formed without the slots 48.

The housing 14 has an openings 76 formed in a bottom thereof, as shown in FIGS. 1B, 3 and 5. The openings 76 accommodate the S-shaped portions 27 and the solder tails 26 of the first and second conductors 16, 18. The portions of the housing 14 that define the openings 76 are preferably contoured to substantially match the shape of the S-shaped portions 27.

The housing 14 can be equipped with a socket or cavity 80, as shown in FIG. 1A. The housing of the 83 of the receptacle connector 30 can be equipped with a projection 82, as shown in FIG. 2A. The projection 82 becomes disposed in the cavity 80 as the connector 10 is mated with the second connector 30. The projection 82 helps to guide the connector 10 during mating. The projection 82 and the cavity 80 are configured to allow the connector 10 and the second connector 30 to be misaligned by as much as approximately 3.5 mm in the "x" direction, and as much as 2.5 mm in the "y" direction at the start of the mating process. The configuration of the projection 82 and the cavity 80 also permits the connector 10 and the second connector 30 to be angled in relation to each other in the "x-z" plane by as much as approximately 6° at the start of the mating process.

Figure 13:
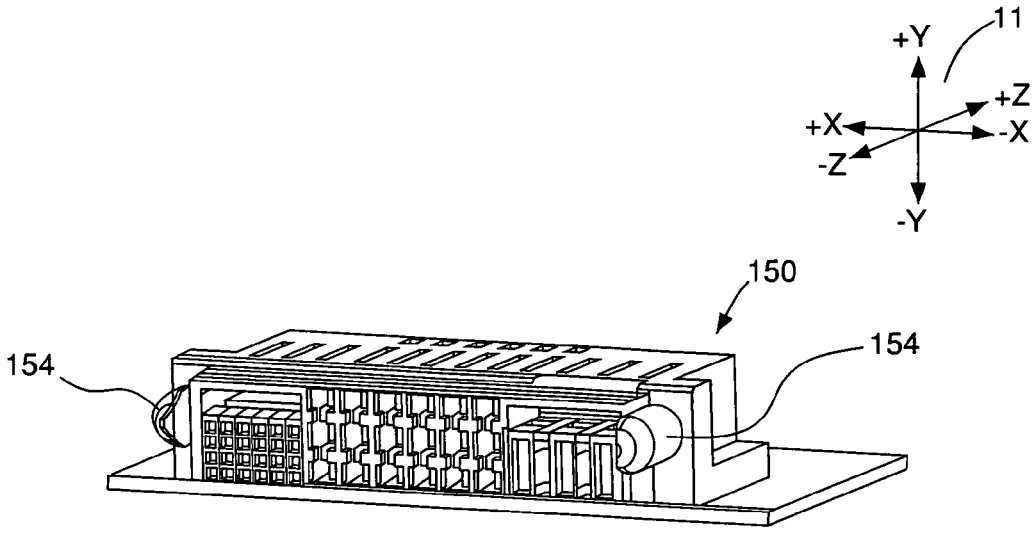
FIG. 13 is a front perspective view of an alternative embodiment of the connector shown in FIG. 1.
Figure 14A:
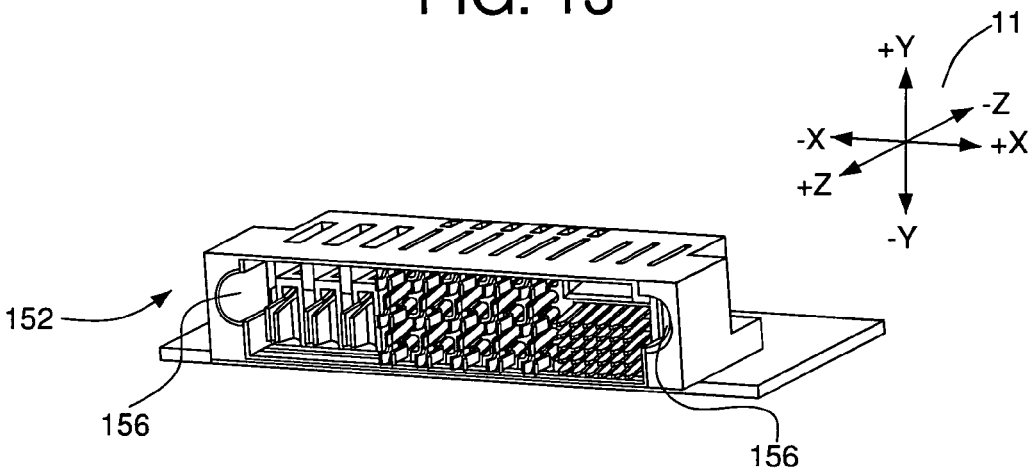
FIG. 14A is a front perspective view of a connector capable of mating with the connector shown in FIG. 13.
Figure 14B:
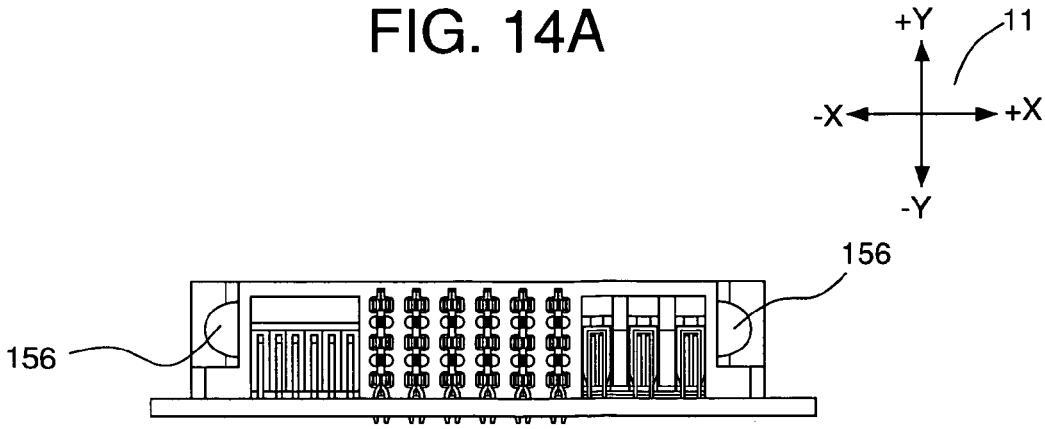
FIG. 14B is a rear view of the connector shown in FIG. 14A.

Alternative embodiments of the connector 10 and the second connector 30 can be formed without the projection 82 or the cavity 80. For example, FIGS. 13-14B depict a receptacle connector 150 and a plug connector 152. The housing of the receptacle connector 150 has two pins 154 formed proximate opposite ends thereof. The pins 154 become disposed in sockets 156 formed in the housing of the plug connector 152 as the receptacle connector 150 and the plug connector 152 are mated. The pins 154, and the housing surfaces that define the sockets 156 are contoured so as to guide the receptacle connector 150 and the plug connector 152 into alignment during mating. The receptacle connector 150 and the plug connector 152 otherwise are substantially identical to the connector 10 and the second connector 20, respectively.

The power contacts 15 include features that help to maintain the first and second conductors 16, 18 in a state of alignment during, and after insertion of the first and second conductors 16, 18 into the housing 14. In particular, the first conductor 16 includes two buttons, or projections 100 extending from a major surface 102 of the plate 20*a*, as shown in FIGS. 3, 4, 6, and 8-10. The plate 20*b* of the second conductor 18 has two penetrations, or through holes 106 formed therein, as depicted in FIGS. 3, 4, and 7-10. The projections 100 and the through holes 106 are positioned so that each through hole 106 receives an associated one of the projections 100 when the first and second conductors 16, 18 are aligned as shown in FIGS. 3 and 8.

Figure 10:
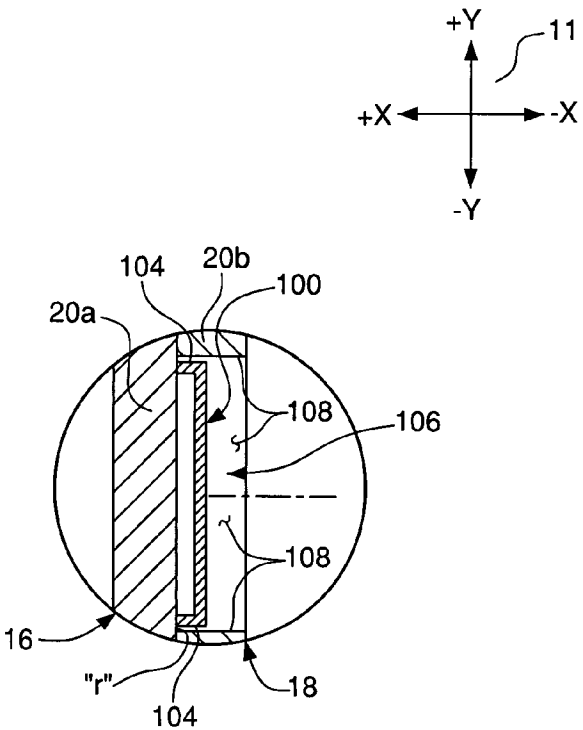
FIG. 10 is a magnified view of the area designated "D" in FIG. 9.
Figure 9:
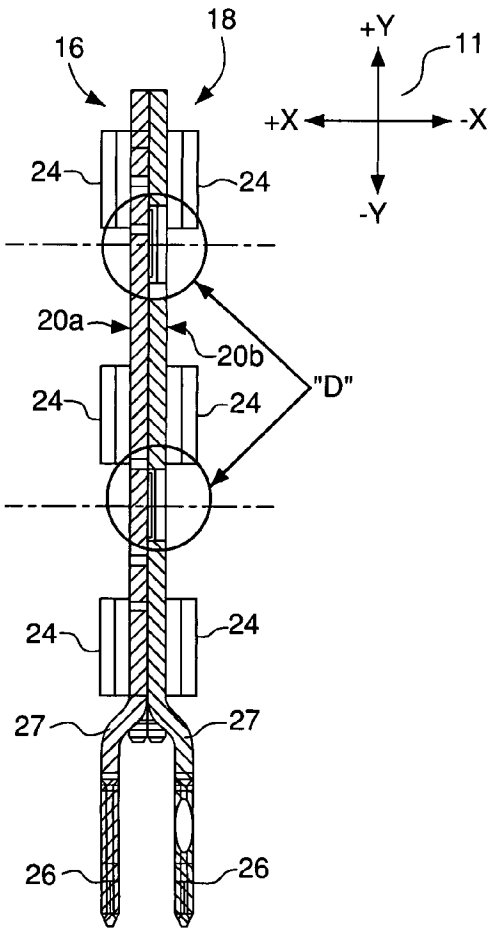
FIG. 9 is a rear cross-sectional view of the first and second conductors shown in FIGS. 3, 4, and 6-8, in a mated condition and depicting projections of the first conductor positioned within corresponding through holes of the second conductor, taken through the line "C-C" of FIGS. 6 and 7.

Each projection 100 is preferably hollow, and preferably has a substantially cylindrical shape as depicted, for example, in FIG. 10. Preferably, the cross-section of each projection 100 is substantially uniform over the length thereof. The projections 100 preferably extend in a direction substantially perpendicular to the major surface 102 of the plate 20*a*, so that an outer peripheral surface 104 of the projection 100 is substantially perpendicular to the major surface 102 of the plate 20*a*.

The projections 100 are preferably formed so as to minimize the radius at the interface between the outer surface 104 and the major surface 102; this radius is denoted by the reference symbol "r" in FIG. 10. Minimizing the radius "r" allows the major surface 102 to lie substantially flat against the adjacent surface of the plate 20*b* of the second conductor 18, when the first and second conductors 16, 18 are mated.

Figure 7:
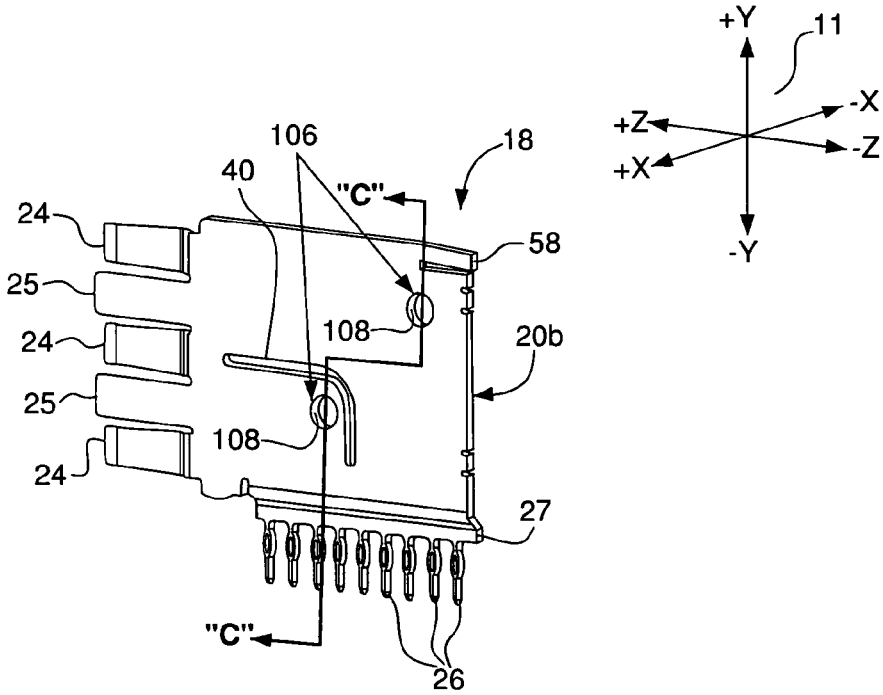
FIG. 7 is a rear perspective view the second conductor shown in FIGS. 3 and 4.
Figure 8:
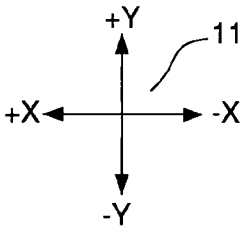
FIG. 8 is a rear view of the first and second conductors shown in FIGS. 3, 4, 6, and 7, in an unmated condition.
Figure 8:
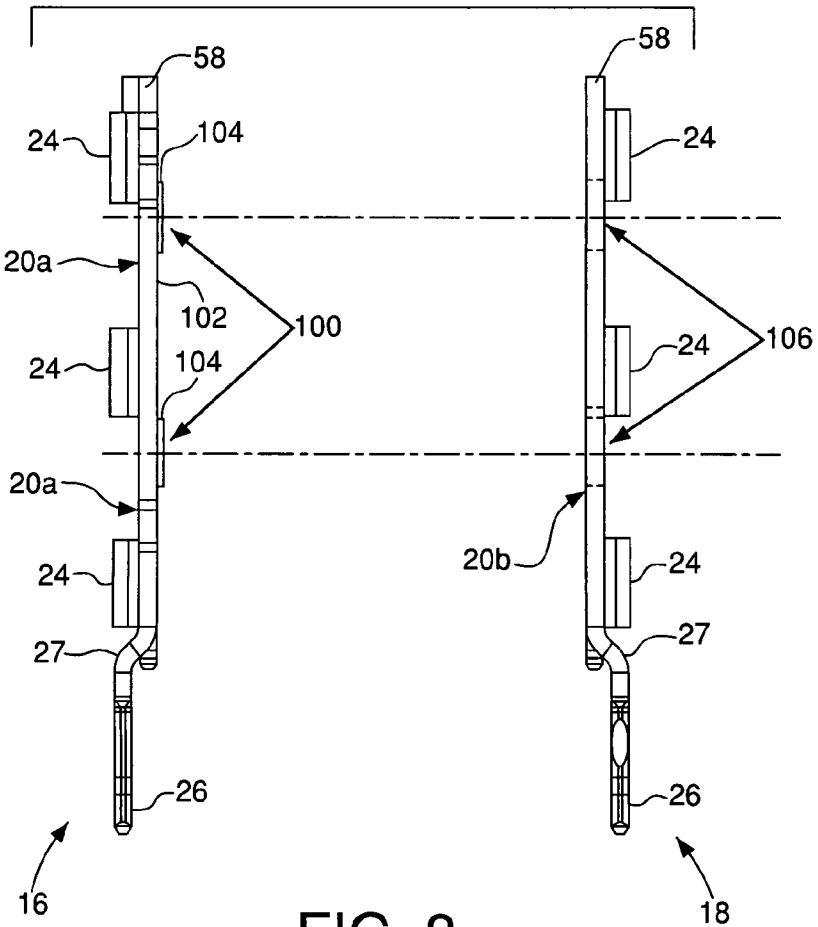

Each through hole 106 is defined by a surface 108 of the plate 20*b*; as shown in FIGS. 7 and 10. The projections 100 and the through holes 106 are preferably sized so that each projection 100 fits within its associated through hole 106 with substantially no clearance between the surface 108, and the outer surface 104 of the projection 100. A clearance is depicted between the surface 108 and the outer surface 104 in FIG. 10, for clarity of illustration. Alternative embodiments can be configured so that a minimal clearance exists between the surface 108 and the outer surface 104.

Preferably, the end of each projection 100 distal the major surface 102 is substantially flat. The length of each projection 100 is preferably selected so that the projection 100 extends into, but not beyond the corresponding through hole 106, as shown in FIG. 10. The extent to which the projection 100 extends into the through hole 106 can be greater or less than that shown in FIG. 10 in alternative embodiments.

The engagement of the outer surface 104 of each projection 100 and the associated surface 108 of the plate 20*b* causes the first conductor 16 to exert a restraining force on the second conductor 18. The restraining force acts in both the "y" and "z" directions. The restraining force helps to maintain the first and second conductors 16, 18 in a state of alignment during and after insertion into the housing 14.

Maintaining the first and second conductors 16, 18 in a state of alignment can help ensure that the first and second conductors 16, 18 initially assume, and remain in their proper respective positions within the associated aperture 17 of the housing 14. Hence, the projections 100 and the through holes 106 can help minimize the potential for misalignment between the contact beams 24, 25 of the first and second conductors 16, 18, thereby promoting proper mating with the second connector 30. The potential for misalignment between the solder tails 26 and the associated through holes in the substrate 12 can also be minimized through the use of the projections 100 and the through holes 106.

The ability of the projections 100 to maintain a first and a second conductor, such as the first and second conductors, 16, 18, in a state of alignment can be particularly beneficial in applications, such has the connector 10, where an interference fit is created as the conductors are inserted into their associated housing.

Figure 11B:
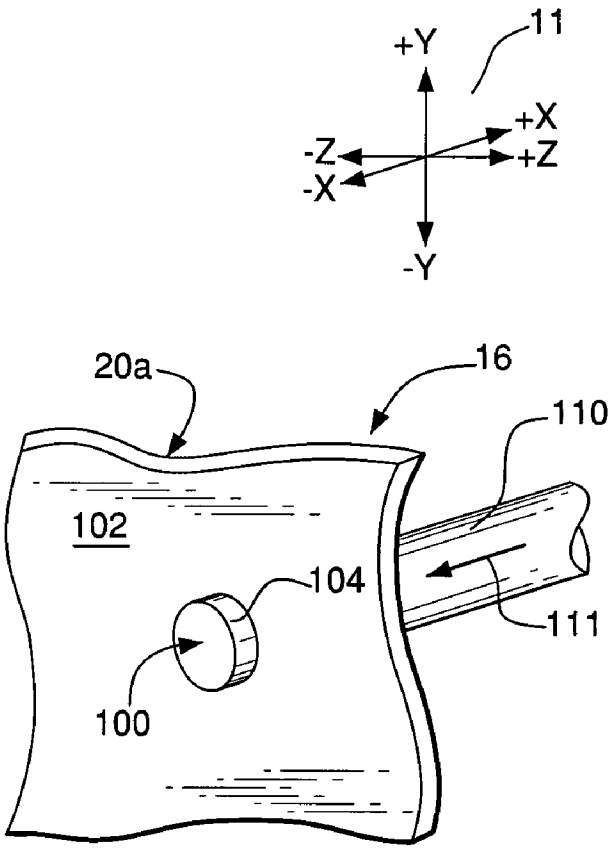
FIGS. 11A and 11B are perspective views depicting a punch forming a projection in the first conductor shown in FIGS. 3, 4, 6, and 8-10.
Figure 11A:
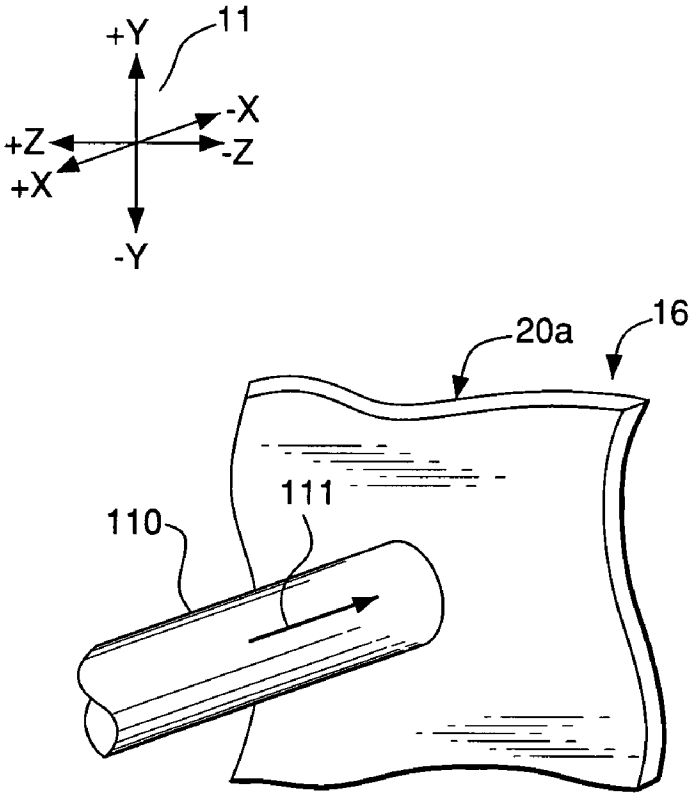
Figure 12B:
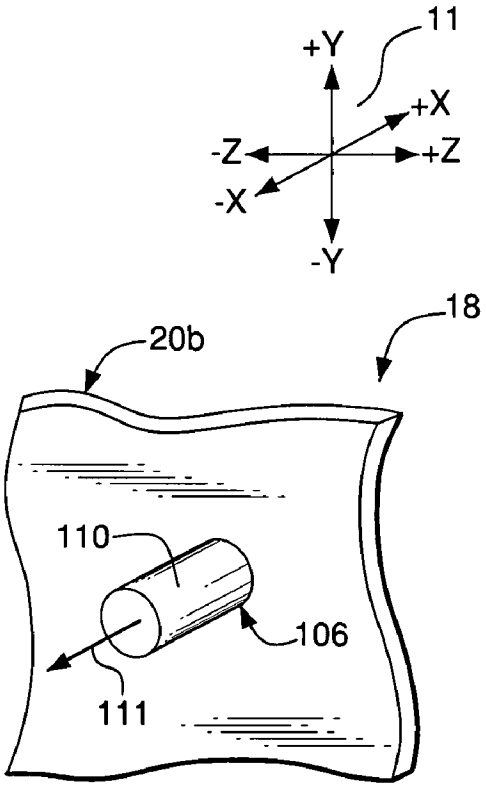
FIGS. 12A and 12B are perspective views depicting a punch forming a projection in the second conductor shown in FIGS. 3, 4, and 7-9.
Figure 12A:
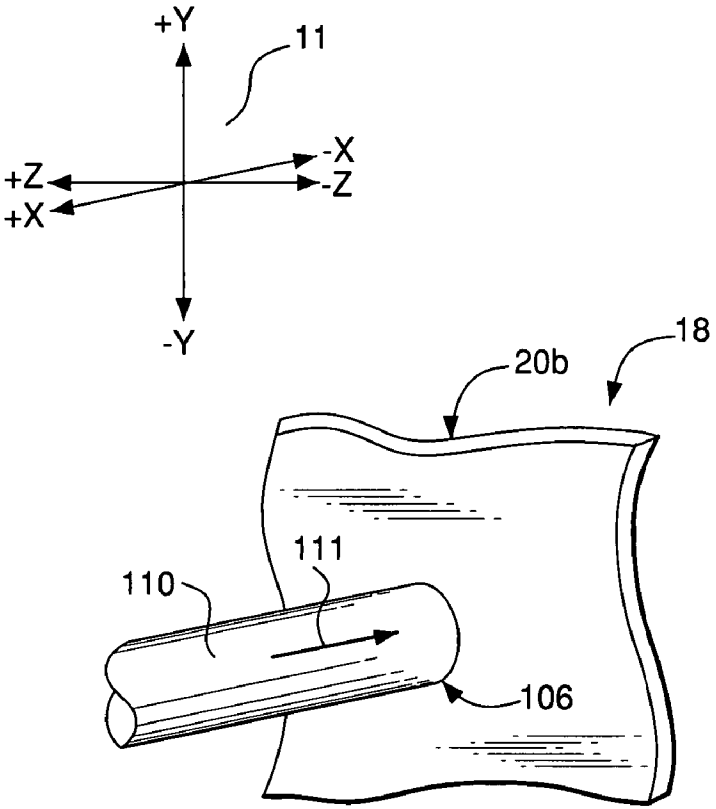

Each projection 100 can be formed using a punch 110, as shown in FIGS. 11A and 11B. The punch 110 can be actuated by a suitable means such as a hydraulic or pneumatic press (not shown). The same punches 110 can also be used to form the through holes 106, as shown in FIGS. 12A and 12B. More particularly, each punch 110 can be moved through a relatively short stroke during formation of the projections 100, so that the punches 110 displace, but do not penetrate through the material of the contact plate 20*a*, as shown in FIGS. 11A and 11B. The direction of motion of the punches 110 is denoted by the arrows 111 in FIGS. 11-12B. The punches 110 can be moved through a longer stroke when forming the through holes 106, so that the punches 110 penetrate through the plate 20*b* as shown in FIGS. 12A and 12B.

The use of punches 110 to form the projections 100 and the through holes 106 is disclosed for exemplary purposes only. The projections 100 and the through holes 106 can be formed by other suitable means in the alternative.

The configuration of the power contacts 15 can help minimize stresses on the housing 14 of the connector 10 when the power contacts 15 are mated with the complementary power contacts 15*a* of the receptacle connector 30, as follows.

Figure 21:
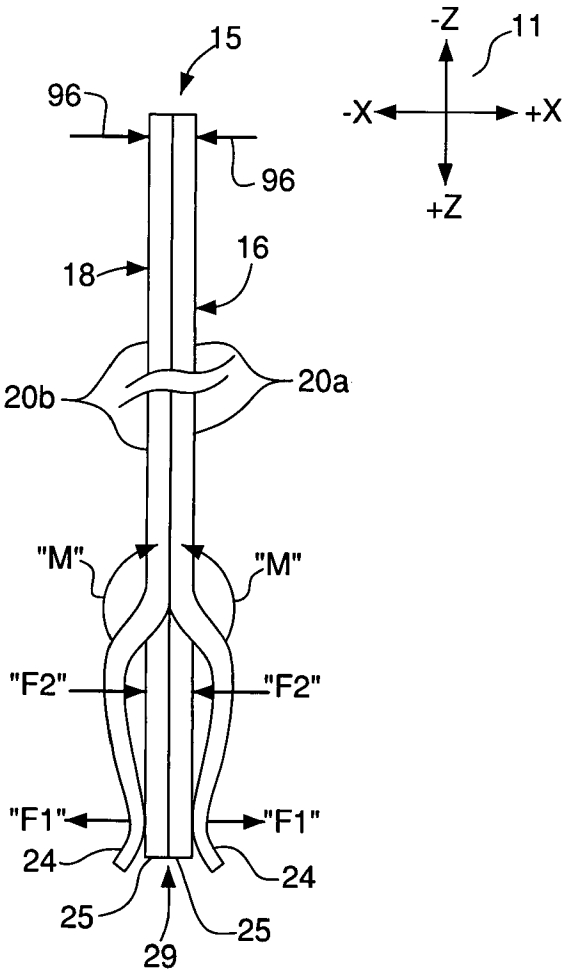
FIG. 21 is a top view of one of the power contacts depicted in FIG. 20.

Each contact beam 24 of the first conductor 20*a* faces a corresponding contact beam 24 of the second conductor 20*b* to form associated pairs of contact beams 24 as shown, for example, in FIGS. 20 and 21. Each pair of associated contact beams 24 receives a contact blade 29*a* from a power contact 15*a* of the receptacle connector 30 when the connector 10 and the receptacle connector 30 are mated. The pair of associated contact beams 24 resiliently deflect outwardly, i.e., away from each other, when the contact blade 29*a* is inserted therebetween.

The resilient deflection of the contact beams 24 of the power contact 15 causes the associated contact beams 25*a* of the power contact 15*a* to exert reactive forces on the contact beams 24. These forces are designated "F1" in FIGS. 20 and 21. The power contact 15*a* is not shown in FIGS. 20 and 21, for clarity. Details of the power contacts 15*a* are shown, for example, in FIG. 2C.

The forces F1 are believed to be of substantially equal magnitude, and act in substantially opposite directions. As the contact beams 24 adjoin the forward portions of the plates 20*a*, 20*b* of the respective conductors 16, 18, the forces F1 urge the forward portions of the plates 20*a*, 20*b* outwardly, away from each other.

Each contact beam 25 of the first conductor 16 of the power contact 15 faces a corresponding contact beam 25 of the second conductor 18 to form a contact blade 29. Each contact blade 29 of the power contact 15 is received between an associated pair of contact beams 24*a* on the power contact 15*a* when the connector 10 and the receptacle connector 30 are mated. The contact beams 24*a* of the power contact 15*a* resiliently deflect in an outward direction, i.e., away from each other, when the contact blade 29 is inserted therebetween.

The resilient deflection of the contact beams 24*a* of the power contact 15*a* causes the contact beams 24*a* to generate reactive forces denoted by the symbol "F2" in FIGS. 20 and 21. The forces F2 act inwardly, in opposing directions, against the associated contact beams 25 of the power contact 15, and are believed to be of substantially equal magnitude. The forces F2 thus urge the contact beams 25 toward each other.

The contact beams 25, in turn, urge the adjoining forward portions of the plates 20*a*, 20*b* of the power contact 15 toward each other. In other words, the contact beams 24*a* of the power contact 15*a* clamp the associated contact beams 25 of the power contact 15 together. This clamping action prevents the forward portions of the plates 20*a*, 20*b* of the power contact 15 from separating due to the outward forces F1 associated with the contact beams 24 of the power contact 15.

The forces F1, in combination with the clamping effect of the contact beams 24*a* on the forward portions of the plates 20*a*, 20*b* of the power contact 15, are believed to generate moments on the plates 20*a*, 20*b*. These moments are designated "M" in FIGS. 20 and 21. The moments M are of substantially equal magnitude, and act in substantially opposite directions. The moments "M" urge the rearward ends of the plates 20*a*, 20*b* of the power contact 15 toward each other, in the directions denoted by the arrows 96 in FIG. 21.

The configuration of the power contacts 15 thus causes the forward and rearward ends of the plates 20*a*, 20*b* to be drawn toward each other when the connector 10 is mated with the receptacle connector 30. The first and second conductors 16, 18 therefore do not exert a substantial force on the adjacent walls of the housing 14. In other words, the structure of the power contact 15 itself, rather than the housing 14, holds the first and second conductors 16, 18 together when the connector 10 and the receptacle connector 30 are mated. As the housing 14 does not perform the function of holding the first and second conductors 16, 18 together, the housing 14 is not subjected to the stresses associated with that function.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

For example, the principles of the invention have been described in relation to the connector 10 for exemplary purposes only. The present invention can be applied to other types of connectors comprising contacts formed by two or more abutting conductors.

Alternative embodiments of the first and second conductors can include more, or less than two of the projections 100 and two of the through holes 106. Moreover, the projections 100 can have a configuration other than cylindrical in alternative embodiments. For example, the projections having a substantially square or rectangular cross sections can be used in the alternative.

The projections 100 and the through holes 106 can be located in positions other than those depicted in the figures, in alternative embodiments. Moreover, alternative embodiments of the second conductor 18 can include indentations in the plate 20*b* in lieu of the through holes 106, to accommodate the projections 100.

Figure 15:
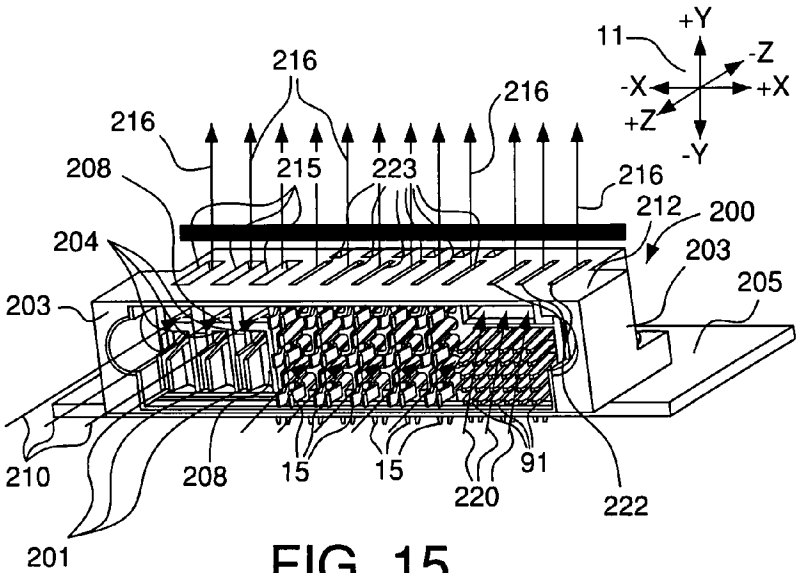
FIG. 15 is a perspective view of another alternative embodiment of the connector shown in FIG. 1.
Figure 17:
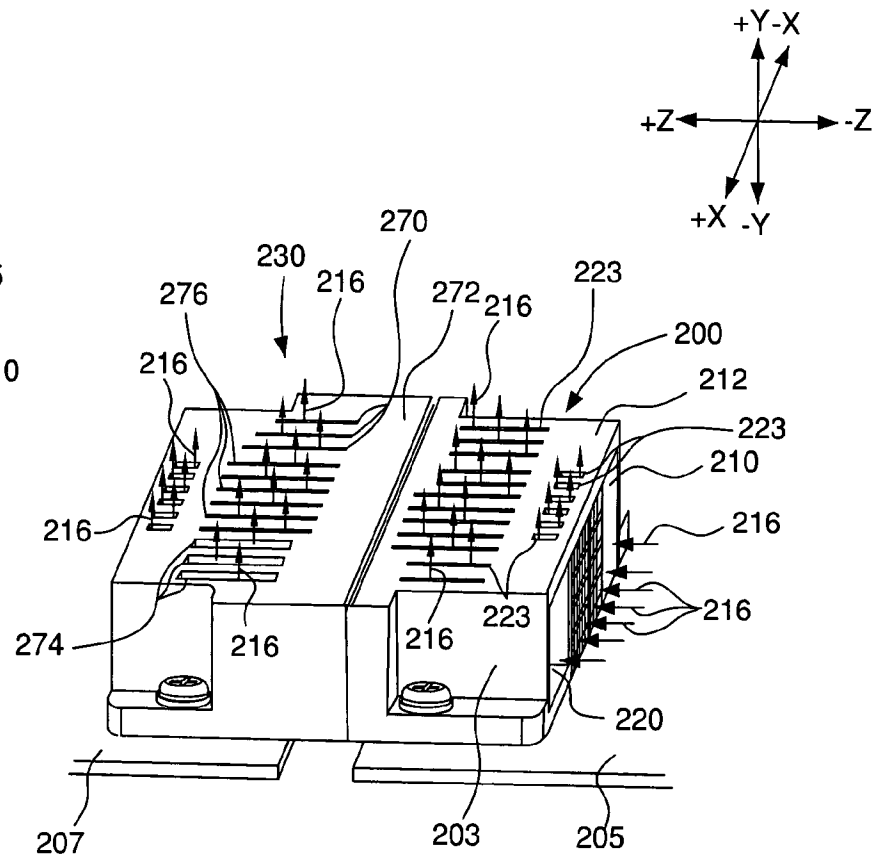
FIG. 17 is a perspective view of the connectors shown in FIGS. 15 and 16, in a mated condition.
Figure 19:
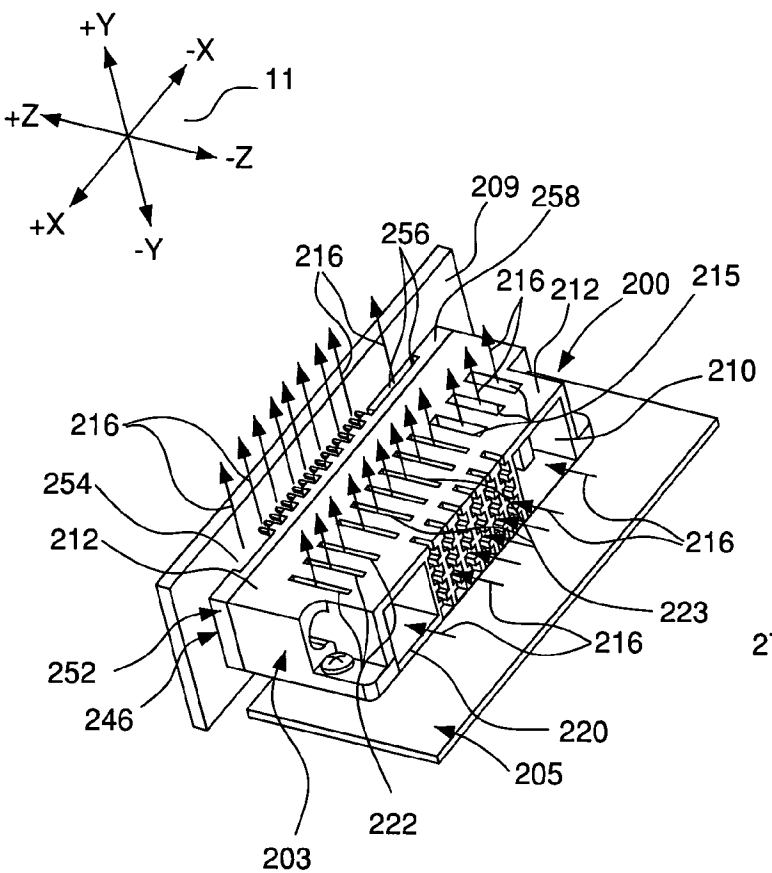
FIG. 19 is a perspective view of the connectors shown in FIGS. 15 and 18, in a mated condition.

FIGS. 15, 17, and 19 depict an alternative embodiment of the connector 10 in the form of a plug connector 200. Components of the connector 200 that are substantially similar to those of the connector 10 are represented by identical reference characters in the figures.

The connector 200 can be mounted on a substrate such as a daughter card 205. The connector 200 can be mounted on other types of substrates in the alternative. The connector 200 can include one or more power contacts 201 for conducting alternating (AC) current, and a housing 203. Each contact 201 can include a first and a second portion having alignment features such as the projections 100 and the through holes 106, as described above in relation to the contacts 15. The connector 200 can also include one or more of the power contacts 15 for conducting direct (DC) current.

The housing 203 includes a plurality of silos 204, as shown in FIG. 15. Each silo 204 is associated with a corresponding one of the contacts 201. Each contact 201 is received in an aperture 208 formed in its associated silo 204. The contacts 201 can be retained in their associated apertures 208 in the manner described above in relation to the power contacts 15 and the apertures 17 of the housing 14 of the connector 10.

The housing 203 includes an upper wall 212. The upper wall 212 is spaced apart from upper portions of the silos 204 to form a vent or passage 210 within the housing 203, as shown in FIG. 15. The passage 210 extends between the front and back of the housing 203, from the perspective of FIG. 15. The aperture 208 of each silo 204 adjoins the passage 210, and facilitates convective heat transfer between the associated contact 201 and the passage 210 as the contacts 201 become heated during operation of the connector 200.

Apertures 215 are formed in the upper wall 212 of the housing 203, as shown in FIGS. 15 and 17. The apertures 215 adjoin the passage 210, and facilitate convective heat transfer from the passage 210 and into the ambient environment around the connector 200 during operation of the connector 200. More specifically, air heated by the contacts 201 can rise out of the associated silos 204, and enter the passage 210 by way of the apertures 208 in the silos 204. The airflow paths that are believed to exist in and around the connector 200 during operation are represented by the arrows 216 in the figures. It should be noted that the arrows 216 are included for illustrative purposes only, and are not intended to fully represent the relatively complex airflow patterns that may actually exist in and around the connector 200.

The heated air can rise out of the passage 210 and exit into the ambient environment by way of the apertures 215. Relatively cool air can enter the passage 210 to replace the heated air that exits the passage 210 by way of the apertures 215.

The connector 200 also includes an array of signal contacts 19 as described above in relation to the connector 10. A vent or passage 220 can be formed between the array of signal contacts 19 and the upper wall 212, as shown in FIG. 17. Apertures 222 that adjoin the passage 220 can be formed in the upper wall 212. Air heated by the signal contacts 19 can rise into the passage 220, and exit the connector 200 by way of the apertures 222. Relatively cool air can enter the passage 220 to replace the heated air that exits the passage 220 by way of the apertures 222.

Apertures 223 can be formed in the upper wall 212, above each of the contacts 15, to facilitate convective heat transfer from the contacts 15 to the ambient environment.

Figure 16:
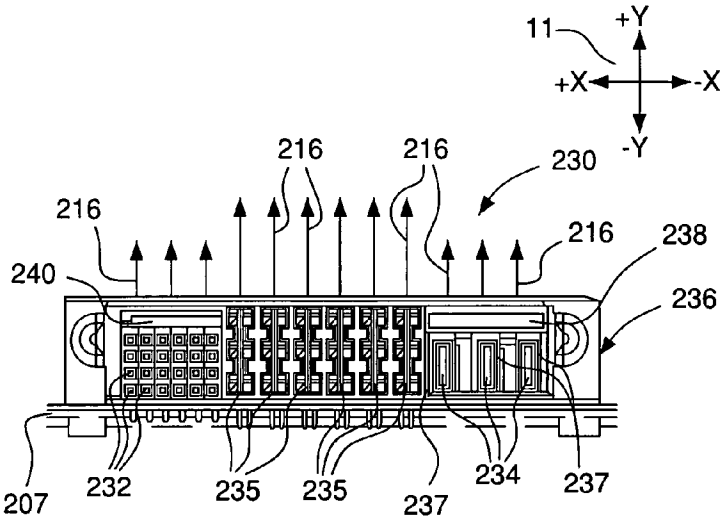
FIG. 16 is a front view of a receptacle connector that mates with the connector shown in FIG. 15.

The connector 200 can mate with a receptacle connector 230 to form a co-planar connector system, as shown in FIGS. 16 and 17. The connector can be mounted on a substrate such as a daughter card 207. The connector 230 can be mounted on other types of substrates in the alternative.

The connector 230 can include receptacle contacts 232 for receiving the signal contacts 91 of the connector 200, and one or more AC power contacts 234 for mating with the contacts 201 of the connector 200. The connector 230 can also include one or more DC power contacts 235 that mate with the contacts 15 of the connector 200.

The connector 230 also includes a housing 236 that receives the contacts 232, 234, 235. The contacts 234 are housed in silos 237 of formed in the housing 236, as shown in FIG. 16. The silos 237 are substantially similar to the silos 204 of the connector 200.

The housing 236 includes a passage 238 formed above the silos 237, and a passage 240 formed above the array of receptacle contacts 232. The passage 238 and the passage 240 extend between the front and back of the connector 230, from the perspective of FIG. 16. The passage 238 and the passage 240 face the respective passages 210, 220 of the connector 200 when the connector 230 is mated with the connector 200.

Apertures 270 that adjoin the passage 238 can be formed in an upper wall 272 of the housing 236, as shown in FIG. 19. Apertures 274 that adjoin the passage 240 can also be formed in the upper wall 272.

The passages 238, 240 and the apertures 270, 274 can facilitate heat transfer from the contacts 234 and the receptacle contacts 232, in the manner discussed above in relation to the passages 210, 220 and the apertures 215, 222 of the connector 200. Air can also flow between the passage 238 and the passage 210, and between the passage 240 and the passage 220, if a temperature differential exists therebetween.

Apertures 276 can be formed in the upper wall 272, above each of the contacts 235, to facilitate convective heat transfer from the contacts 235 to the ambient environment.

Figure 18:
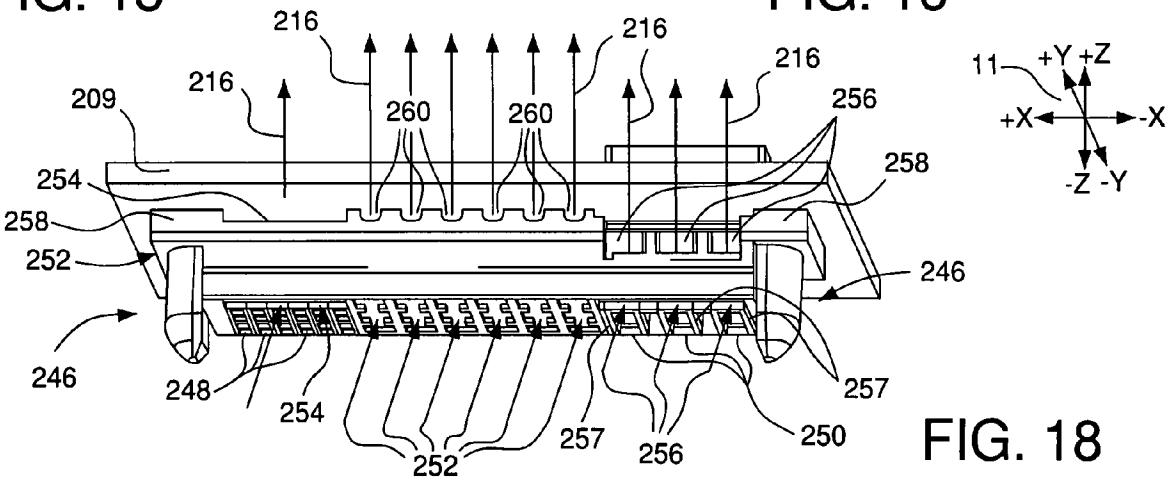
FIG. 18 is a perspective view of another receptacle connector that mates with the connector shown in FIG. 15.

The connector 200 can also mate with a receptacle connector 246, as shown in FIGS. 17 and 18. The connector 246 can be mounted on a substrate such as a backplane 209, so that the connector 246 and the connector 200 form a backplane connector system. The connector 246 can be mounted on other types of substrates in the alternative.

The connector 246 includes receptacle contacts 248, AC power contacts 250, and DC power contacts 252. The contacts 248, 250, 252 are adapted for use with a backplane such as the backplane 209, but are otherwise similar to the respective receptacle contacts 232, AC power contacts 234, and DC power contacts 235 of the receptacle connector 230.

The connector 246 also includes a housing 252 that receives the contacts 248, 250, 252. The housing 252 includes a passage 254 located above the receptacle contacts 248, and a passage 256 located above silos 257 that house the contacts 235, as shown in FIG. 18. The passages 254, 256 extend between the front and back of the housing 252, from the perspective of FIG. 18. The passages 254, 256 extend through an upper wall 258 of the housing 252, proximate the rearward end thereof. The housing 252 also includes vertically-oriented passages 260 formed along the rearward end thereof. Each passage 260 is associated with one of the power contacts 252. The passages 254, 256, 260 permit heated air to exit the housing 252, while allowing relatively cool air to enter.

What is claimed:

1. An electrical connector, comprising:

a housing; and a power contact mounted on the housing and comprising a first conductor and a second conductor that mates with the first conductor, wherein: the power contact is adapted to mate with a second power contact; the first conductor comprises a plurality of terminal ends and a projection that extends from a substantially planar surface of the first conductor; the projection has a peripheral surface oriented in a first direction substantially perpendicular to the substantially planar surface; the second conductor has a surface that defines an aperture that receives the projection when the first and second conductors are mated; and the surface of the second conductor is oriented substantially in the first direction when the first and second conductors are mated so that interference between the peripheral surface of the first conductor and the surface of the second conductor restrains the second conductor from moving in relation to the first conductor.

2. The connector of claim 1, wherein an end of the projection distal the substantially planar surface is substantially flat.

3. The connector of claim 1, wherein the projection has a diameter approximately equal to a diameter of the through hole.

4. The connector of claim 1, wherein the through hole is formed in a major portion of the second conductor, and interference between the projection and the major portion of the second conductor restrains the second conductor in the first and second directions.

5. The connector of claim 1, wherein the projection has a substantially circular cross section.

6. The connector of claim 1, wherein the housing has a projection formed proximate a center thereof, the projection becomes disposed in a cavity formed in a housing of a second connector when the connector is mounted with the second connector, and the projection guides the connector into alignment with the second connector during mating.

7. The connector of claim 1, wherein the first and second conductors each comprise a current guiding feature.

8. The connector of claim 1, wherein a portion of the power contact is located in an aperture formed in the housing, a top portion of the housing has an opening formed therein, and the opening places the aperture in fluid communication an ambient environment around the connector.

9. The connector of claim 1, wherein:

the first conductor comprises a major portion having the projection located thereon, a contact beam mechanically and electrically coupled to the major portion, and a contact terminal mechanically and electrically coupled to the major portion; and the second conductor comprises a major portion having the through hole formed therein, a contact beam mechanically and electrically coupled to the major portion, and a contact terminal mechanically and electrically coupled to the major portion.

10. The connector of claim 1, wherein the first conductor has two of the projections formed thereon, the second conductor has two of the through holes formed therein.

11. The electrical connector of claim 1, wherein the aperture comprises a through hole that is defined by the surface of the second conductor.

12. The electrical connector of claim 1, wherein the first conductor includes a substantially major surface and a minor surface, and the major surface defines a surface area greater than that of the minor surface, and the projection extends from the substantially planar major surface of the first conductor.

13. The electrical connector of claim 1, wherein the projection is substantially hollow.

14. The electrical connector of claim 1, wherein the first conductor comprising a first plate member, a first and a second contact beam adjoining the first plate member, and a projection adjoining and extending from the first plate member;

and the second conductor comprises a second plate member, and a third and a fourth contact beam adjoining the second plate member.

15. The power contact of claim 14, wherein the projection comprises a punched portion formed in the major portion.

16. A power contact, comprising:

a first conductor comprising a major portion, and a pair of substantially cylindrical projections extending from a common surface of the major portion, each projection having a central axis that is substantially perpendicular to the common surface; and a second conductor comprising a major portion having a pair of apertures formed therein for receiving the projections, wherein interference between the projections and the apertures restrains the first conductor in relation to the second conductor when the first conductor is mated with the second conductor; and when the first and second conductors are mated, the power contact is adapted to mate with a second power contact.

17. The connector of claim 16, wherein each projection has a substantially uniform cross section along a length of the projection.

18. The connector of claim 16, wherein an end of each projection distal the major portion is substantially flat.

19. The power contact of claim 16, wherein the projection is integrally formed with the major portion.

20. The power contact of claim 16, wherein the central axes of each projection are offset with respect each other along the common surface.

21. The power contact of claim 16, wherein the common surface is a substantially flat surface of the major portion.

22. The power contact of claim 16, wherein each aperture comprises a through hole extending through the major portion.

23. The power contact of claim 16, wherein the projections are formed on the common surface of the major portion.

24. The power contact of claim 16, wherein the first conductor comprises a first plate member, a first and a second contact beam adjoining the first plate member, and a projection adjoining and extending from the first plate member; and the second conductor comprises a second plate member having a through hole formed therein, and a third and a fourth contact beam adjoining the second plate member.

25. An electrical connector, comprising:

a housing; and a power contact mounted on the housing and comprising a first conductor mated with a second conductor, wherein the first conductor includes a first plate member, a first and a second contact beam adjoining the first plate member, and a projection adjoining and extending from the first plate member;

the second conductor includes a second plate member defining an aperture formed therein, and a third and a fourth contact beam adjoining the second plate member;

the aperture receives the projection when the first conductor is mated with the second conductor;

the first contact beam opposes the third contact beam;

the second contact beam opposes the fourth contact beam so that second and fourth contact beams form a contact blade;

the first and third contact beams are configured to be pushed apart by a contact blade of a power contact of a mating connector when the connector is mated with the mating connector; and the second and fourth contact beams are configured to be received between a pair of contact beams of the power contact of the mating connector when the connector is mated with the mating connector so that the contact beams of the power contact of the mating connector clamp the second and fourth contact beams towards each other.

26. The connector of claim 25, wherein:

the projection has a peripheral surface oriented in a first direction substantially perpendicular to the major surface; the second plate member has a surface that defines the through hole that receives the projection; and the surface of the second plate member is oriented substantially in the first direction so that interference between the peripheral surface of the first plate member and the surface of the second plate member restrains the second plate member in relation to the first plate.

27. The connector of claim 25, wherein the first plate member includes a major surface and a minor surface, and the major surface defines a surface area greater than that of the minor surface, and the projection adjoins and extends from the major surface.

28. The connector of claim 1, wherein the housing has a silo formed therein, the silo receives the power contact, and the silo and an inner surface of the housing define a passage that facilitates heat transfer from the power contact.

29. The connector of claim 28, wherein an upper portion of the silo is spaced from an upper wall of the housing to form the passage.

30. The connector of claim 28, wherein the silo has an aperture formed therein that facilitates heat transfer from the power contact to the passage.

31. The connector of claim 29, wherein the upper wall has an aperture formed therein that facilitates heat transfer from the passage to an ambient environment around the housing.

* * * * *

UNITED STATES PATENT AND TRADEMARK OFFICE

CERTIFICATE OF CORRECTION

PATENT NO. : 7,458,839 B2
APPLICATION NO. : 11/358168
DATED : December 2, 2008
INVENTOR(S) : Ngo et al.

It is certified that error appears in the above-identified patent and that said Letters Patent is hereby corrected as shown below:

COL. 13, line 15 (Claim 20), after "respect" insert --to-- so that the phrase reads "with respect to each . . ."

Signed and Sealed this

Twenty-seventh Day of January, 2009

JOHN DOLL
*Acting Director of the United States Patent and Trademark Office*